US011226106B2

(12) United States Patent
Bruin-Slot et al.

(10) Patent No.: US 11,226,106 B2
(45) Date of Patent: Jan. 18, 2022

(54) VENTILATION SYSTEM FOR COOKING APPLIANCE

(71) Applicant: WHIRLPOOL CORPORATION, Benton Harbor, MI (US)

(72) Inventors: Zachary J. Bruin-Slot, Baroda, MI (US); Massimiliano Daniele, Cassinetta (IT); Robert Scott Donarski, St. Joseph, MI (US); Emilio Fagundes, St. Joseph, MI (US); Gregory Tadeu Gargioni, St. Joseph, MI (US); Vando Sestrem, Joinville (BR); Yasmim Silvano, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 124 days.

(21) Appl. No.: 16/811,598

(22) Filed: Mar. 6, 2020

(65) Prior Publication Data

US 2020/0208844 A1 Jul. 2, 2020

Related U.S. Application Data

(63) Continuation of application No. 16/018,877, filed on Jun. 26, 2018, now Pat. No. 10,627,116.

(51) Int. Cl.

| | |
|---|---|
| ***F24C 15/00*** | (2006.01) |
| ***F24C 15/20*** | (2006.01) |
| ***F24C 15/32*** | (2006.01) |

(52) U.S. Cl.

CPC ..... *F24C 15/006* (2013.01); *F24C 15/2007* (2013.01); *F24C 15/2021* (2013.01); *F24C 15/322* (2013.01)

(58) Field of Classification Search

CPC ..... F24C 15/006; F24C 15/2007; F24C 15/2014; F24C 15/32; F24C 15/322

See application file for complete search history.

(56) References Cited

U.S. PATENT DOCUMENTS

| | | | |
|---|---|---|---|
| 1,141,176 | A | 6/1915 | Copeman |
| 1,380,656 | A | 6/1921 | Lauth |

(Continued)

FOREIGN PATENT DOCUMENTS

| | | | |
|---|---|---|---|
| CA | 2365023 | A1 | 7/2002 |
| CA | 2734926 | A1 | 10/2011 |

(Continued)

OTHER PUBLICATIONS

Built-In Gas Cooktop, image post date Feb. 18, 2015, U.S. Appl. No. 29/539,768 in Restriction Requirement dated Oct. 27, 2016, 10 pages, <http://www.bestbuy.com/site/kitchenaid-36-built-in-gas-cooktop-stainless-steel/8636634.p?skuId=8636634>.

(Continued)

*Primary Examiner* — David J Laux
(74) *Attorney, Agent, or Firm* — Price Heneveld LLP

(57) ABSTRACT

A cooking appliance includes a housing having a heating cavity defined therein, wherein a heat source is in thermal communication with the heating cavity. A cooling channel is disposed proximate a sidewall of the housing. A blower selectively operates to move at least cooling air through the cooling channel and to an air outlet. A vent aperture extends through the sidewall between the heating cavity and a ventilation channel. The ventilation channel includes a narrowed portion proximate the vent aperture, wherein during operation of the blower, the narrowed portion defines a low static pressure region of the ventilation channel that draws cavity air from the heating cavity and directs the cavity air into the ventilation channel to be combined with the cooling air.

9 Claims, 15 Drawing Sheets

(56) References Cited

U.S. PATENT DOCUMENTS 1,405,624 A 2/1922 Patterson
1,598,996 A 9/1926 Wheelock
1,808,550 A 6/1931 Harpman
2,024,510 A 12/1935 Crisenberry
2,530,991 A 11/1950 Reeves
2,536,613 A 1/1951 Schulze et al.
2,699,912 A 1/1955 Cushman
2,777,407 A 1/1957 Schindler
2,781,038 A 2/1957 Sherman
2,791,366 A 5/1957 Geisler
2,815,018 A 12/1957 Collins
2,828,608 A 4/1958 Cowlin et al.
2,847,932 A 8/1958 More
2,930,194 A 5/1960 Perkins
2,934,957 A 5/1960 Reinhart et al.
D191,085 S 8/1961 Kindl et al.
3,017,924 A 1/1962 Jenson
3,051,813 A 8/1962 Busch et al.
3,065,342 A 11/1962 Worden
3,089,407 A 5/1963 Kinkle
3,259,120 A 7/1966 Keating
3,386,431 A 6/1968 Branson
3,463,138 A 8/1969 Lotter et al.
3,489,135 A 1/1970 Astrella
3,548,154 A 12/1970 Christiansson
3,602,131 A 8/1971 Dadson
3,645,249 A 2/1972 Henderson et al.
3,691,937 A 9/1972 Meek et al.
3,731,035 A 5/1973 Jarvis et al.
3,777,985 A 12/1973 Hughes et al.
3,780,954 A 12/1973 Genbauffs
3,857,254 A 12/1974 Lobel
3,877,865 A 4/1975 Duperow
3,899,655 A 8/1975 Skinner
D245,663 S 9/1977 Gordon
4,104,952 A 8/1978 Brass
4,149,518 A 4/1979 Schmidt et al.
4,363,956 A 12/1982 Scheidler et al.
4,413,610 A 11/1983 Berlik
4,418,456 A 12/1983 Riehl
4,447,711 A 5/1984 Fischer
4,466,789 A 8/1984 Riehl
4,518,346 A 5/1985 Pistien
4,587,946 A 5/1986 Doyon et al.
4,592,333 A * 6/1986 Dustin ..... F24C 15/2014 126/21 R
4,601,279 A 7/1986 Guerin
4,646,963 A 3/1987 Delotto et al.
4,654,508 A 3/1987 Logel et al.
4,689,961 A 9/1987 Stratton
4,763,638 A * 8/1988 Hurley ..... F24C 14/025 126/21 A
4,796,600 A * 1/1989 Hurley ..... F24C 14/025 126/21 R
4,812,624 A 3/1989 Kern
4,818,824 A 4/1989 Dixit et al.
4,846,671 A 7/1989 Kwiatek
4,886,043 A 12/1989 Homer
4,891,936 A 1/1990 Shekleton et al.
D309,398 S 7/1990 Lund
4,981,416 A 1/1991 Nevin et al.
4,989,404 A 2/1991 Shekleton
5,021,762 A 6/1991 Hetrick
5,136,277 A 8/1992 Civanelli et al.
5,171,951 A 12/1992 Chartrain et al.
D332,385 S 1/1993 Adams
5,190,026 A 3/1993 Doty
5,215,074 A 6/1993 Wilson et al.
5,243,172 A 9/1993 Hazan et al.
D340,383 S 10/1993 Addison et al.
5,272,317 A 12/1993 Ryu
D342,865 S 1/1994 Addison et al.
5,316,423 A 5/1994 Kin
5,397,234 A 3/1995 Kwiatek
5,448,036 A 9/1995 Husslein et al.
D364,993 S 12/1995 Andrea
5,491,423 A 2/1996 Turetta
D369,517 S 5/1996 Ferlin
5,546,927 A 8/1996 Lancelot
5,571,434 A 11/1996 Cavener et al.
D378,578 S 3/1997 Eberhardt
5,618,458 A 4/1997 Thomas
5,640,497 A 6/1997 Shute
5,649,822 A 7/1997 Gertler et al.
5,735,261 A 4/1998 Kieslinger
5,738,081 A * 4/1998 Puricelli ..... F24C 14/02 126/21 A
5,785,047 A 7/1998 Bird et al.
5,842,849 A 12/1998 Huang
5,913,675 A 6/1999 Vago et al.
5,928,540 A 7/1999 Antoine et al.
D414,377 S 9/1999 Huang
5,967,021 A 10/1999 Yung
6,016,096 A 1/2000 Barnes et al.
6,030,207 A 2/2000 Saleri
6,049,267 A 4/2000 Barnes et al.
6,050,176 A 4/2000 Schultheis et al.
6,078,243 A 6/2000 Barnes et al.
6,089,219 A 7/2000 Kodera et al.
6,092,518 A 7/2000 Dane
6,111,229 A 8/2000 Schultheis
6,114,665 A 9/2000 Garcia et al.
6,133,816 A 10/2000 Barnes et al.
6,155,820 A 12/2000 Döbbeling
6,188,045 B1 2/2001 Hansen et al.
6,192,669 B1 2/2001 Keller et al.
6,196,113 B1 3/2001 Yung
6,253,759 B1 7/2001 Giebel et al.
6,253,761 B1 7/2001 Shuler et al.
6,320,169 B1 11/2001 Clothier
6,322,354 B1 11/2001 Carbone et al.
6,362,458 B1 3/2002 Sargunam et al.
6,452,136 B1 9/2002 Berkcan et al.
6,452,141 B1 9/2002 Shon
6,589,046 B2 7/2003 Harneit
6,614,006 B2 9/2003 Pastore et al.
6,619,280 B1 9/2003 Zhou et al.
6,655,954 B2 12/2003 Dane
6,663,009 B1 12/2003 Bedetti et al.
6,718,965 B2 4/2004 Rummel et al.
6,733,146 B1 5/2004 Vastano
6,806,444 B2 10/2004 Lerner
6,837,151 B2 1/2005 Chen
6,891,133 B2 5/2005 Shozo et al.
6,910,342 B2 6/2005 Berns et al.
6,913,012 B2 7/2005 Divett et al.
6,930,287 B2 8/2005 Gerola et al.
6,953,915 B2 10/2005 Garris, III
7,005,614 B2 2/2006 Lee
7,017,572 B2 3/2006 Cadima
D524,105 S 7/2006 Poltronieri
7,083,123 B2 8/2006 Molla
7,220,945 B1 5/2007 Wang
D544,753 S 6/2007 Tseng
7,274,008 B2 9/2007 Arnal Valero et al.
7,281,715 B2 10/2007 Boswell
7,291,009 B2 11/2007 Kamal et al.
7,315,247 B2 1/2008 Jung et al.
7,325,480 B2 2/2008 Grühbaum et al.
D564,296 S 3/2008 Koch et al.
7,348,520 B2 3/2008 Wang
7,368,685 B2 5/2008 Nam et al.
7,411,160 B2 8/2008 Duncan et al.
7,414,203 B2 8/2008 Winkler
7,417,204 B2 8/2008 Nam et al.
7,429,021 B2 9/2008 Sather et al.
D581,736 S 12/2008 Besseas
7,468,496 B2 12/2008 Marchand
D592,445 S 5/2009 Sorenson et al.
7,527,495 B2 5/2009 Yam et al.
D598,959 S 8/2009 Kiddoo
7,589,299 B2 9/2009 Fisher et al.
D604,098 S 11/2009 Hamlin
7,614,877 B2 11/2009 McCrorey et al.

(56) References Cited

U.S. PATENT DOCUMENTS 7,628,609 B2 12/2009 Pryor et al.
7,640,930 B2 1/2010 Little et al.
7,696,454 B2 4/2010 Nam et al.
7,708,008 B2 5/2010 Elkasevic et al.
7,721,727 B2 5/2010 Kobayashi
7,731,493 B2 6/2010 Starnini et al.
7,762,250 B2 7/2010 Elkasevic et al.
7,770,985 B2 8/2010 Davis et al.
7,781,702 B2 8/2010 Nam et al.
7,823,502 B2 11/2010 Hecker et al.
7,829,825 B2 11/2010 Kühne
7,840,740 B2 11/2010 Minoo
7,841,333 B2 11/2010 Kobayashi
7,964,823 B2 6/2011 Armstrong et al.
D642,675 S 8/2011 Scribano et al.
8,006,687 B2 8/2011 Watkins et al.
8,015,821 B2 9/2011 Spytek
8,037,689 B2 10/2011 Oskin et al.
8,057,223 B2 11/2011 Pryor et al.
8,141,549 B2 3/2012 Armstrong et al.
8,217,314 B2 7/2012 Kim et al.
8,220,450 B2 7/2012 Luo et al.
8,222,578 B2 7/2012 Beier
D665,491 S 8/2012 Goel et al.
8,272,321 B1 9/2012 Kalsi et al.
8,288,690 B2 10/2012 Boubeddi et al.
8,302,593 B2 11/2012 Cadima
8,304,695 B2 11/2012 Bonuso et al.
8,342,165 B2 1/2013 Watkins
8,344,292 B2 1/2013 Franca et al.
8,356,367 B2 1/2013 Flynn
8,393,317 B2 3/2013 Sorenson et al.
8,398,303 B2 3/2013 Kuhn
8,430,310 B1 4/2013 Ho et al.
8,464,703 B2 6/2013 Ryu et al.
D685,225 S 7/2013 Santoyo et al.
D687,675 S 8/2013 Filho et al.
8,526,935 B2 9/2013 Besore et al.
8,535,052 B2 9/2013 Cadima
D693,175 S 11/2013 Saubert
8,584,663 B2 11/2013 Kim et al.
8,596,259 B2 12/2013 Padgett et al.
8,616,193 B2 12/2013 Padgett
8,660,297 B2 2/2014 Yoon et al.
8,687,842 B2 4/2014 Yoon et al.
8,689,782 B2 4/2014 Padgett
8,707,945 B2 4/2014 Hasslberger et al.
8,747,108 B2 6/2014 Lona Santoyo et al.
8,800,543 B2 8/2014 Simms et al.
D718,061 S 11/2014 Wu
8,887,710 B2 11/2014 Rossi et al.
8,930,160 B2 1/2015 Wall et al.
8,932,049 B2 1/2015 Ryu et al.
8,950,389 B2 2/2015 Horstkoetter et al.
8,978,637 B2 3/2015 Ryu et al.
D727,489 S 4/2015 Rohskopf et al.
9,021,942 B2 5/2015 Lee et al.
9,074,765 B2 7/2015 Armanni
D735,525 S 8/2015 Nguyen
9,113,503 B2 8/2015 Arnal Valero et al.
9,132,302 B2 9/2015 Luongo et al.
D743,203 S 11/2015 Filho et al.
9,175,858 B2 11/2015 Tisselli et al.
D750,314 S 2/2016 Hobson et al.
9,307,888 B2 4/2016 Baldwin et al.
D758,107 S 6/2016 Hamilton
9,400,115 B2 7/2016 Kuwamura
D766,036 S 9/2016 Koch et al.
D766,696 S 9/2016 Kemker
9,513,015 B2 12/2016 Estrella et al.
9,521,708 B2 12/2016 Adelmann et al.
9,557,063 B2 1/2017 Cadima
9,572,475 B2 2/2017 Gephart et al.
9,644,847 B2 5/2017 Bhogal et al.
9,677,770 B2 6/2017 Lee et al.
9,696,042 B2 7/2017 Hasslberger et al.
9,879,864 B2 1/2018 Gutierrez et al.
9,927,129 B2 3/2018 Bhogal et al.
2002/0065039 A1 5/2002 Benezech et al.
2004/0007566 A1 1/2004 Staebler et al.
2004/0031782 A1 2/2004 Westfield
2004/0195399 A1 10/2004 Molla
2004/0224273 A1 11/2004 Inomata
2004/0224274 A1 11/2004 Tomiura
2005/0029245 A1 2/2005 Gerola et al.
2005/0112520 A1 5/2005 Todoli et al.
2005/0199232 A1 9/2005 Gama et al.
2005/0224490 A1* 10/2005 Austin ..... F24C 15/006 219/408
2005/0268000 A1 12/2005 Carlson
2005/0268794 A1 12/2005 Nesterov
2007/0124972 A1 6/2007 Ratcliffe
2007/0181410 A1 8/2007 Baier
2007/0251936 A1 11/2007 Nam et al.
2007/0281267 A1 12/2007 Li
2008/0029081 A1 2/2008 Gagas
2008/0050687 A1 2/2008 Wu
2008/0110879 A1 5/2008 Marchand
2008/0173632 A1 7/2008 Jang et al.
2008/0184985 A1* 8/2008 Hasslberger ..... F24C 15/006 126/21 R
2008/0185373 A1* 8/2008 Elkasevic ..... F24C 15/006 219/394
2008/0185942 A1* 8/2008 Elkasevic ..... F24C 15/006 312/236
2008/0210685 A1 9/2008 Beier
2009/0173730 A1 7/2009 Baier et al.
2009/0183723 A1* 7/2009 Hasslberger ..... F24C 15/006 126/21 A
2009/0320823 A1 12/2009 Padgett
2010/0035197 A1 2/2010 Cadima
2010/0114339 A1 5/2010 Kaiser et al.
2010/0126496 A1 5/2010 Luo et al.
2010/0139640 A1* 6/2010 Watkins ..... F24C 15/006 126/21 A
2010/0154776 A1 6/2010 Czajka et al.
2010/0192939 A1 8/2010 Parks
2011/0027733 A1 2/2011 Yamamoto et al.
2011/0142998 A1 6/2011 Johncock et al.
2011/0163086 A1 7/2011 Aldana Arjol et al.
2011/0248021 A1 10/2011 Gutierrez et al.
2012/0017595 A1 1/2012 Liu
2012/0024835 A1 2/2012 Artal Lahoz et al.
2012/0036855 A1 2/2012 Hull
2012/0037142 A1* 2/2012 Chilton ..... F24C 3/008 126/21 R
2012/0067334 A1 3/2012 Kim et al.
2012/0076351 A1 3/2012 Yoon et al.
2012/0099761 A1 4/2012 Yoon et al.
2012/0160228 A1 6/2012 Kim et al.
2012/0171343 A1 7/2012 Cadima et al.
2012/0261405 A1 10/2012 Kurose et al.
2013/0043239 A1 2/2013 Anton Falcon et al.
2013/0252188 A1 9/2013 Chen
2013/0255663 A1 10/2013 Cadima et al.
2013/0260618 A1 10/2013 Bally et al.
2014/0048055 A1 2/2014 Ruther
2014/0071019 A1 3/2014 Lim
2014/0090636 A1 4/2014 Bettinzoli
2014/0097172 A1 4/2014 Kang et al.
2014/0116416 A1 5/2014 Saubert
2014/0137751 A1 5/2014 Bellm
2014/0139381 A1 5/2014 Sippel
2014/0318527 A1 10/2014 Silva et al.
2014/0352549 A1 12/2014 Upston et al.
2015/0096974 A1 4/2015 Freeman et al.
2015/0136760 A1 5/2015 Lima et al.
2015/0153041 A1 6/2015 Neumeier
2015/0241069 A1* 8/2015 Brant ..... F24C 15/006 126/21 A
2015/0330640 A1 11/2015 Stork genannt Wersborg
2015/0345800 A1 12/2015 Cabrera Botello
2015/0359045 A1 12/2015 Neukamm et al.

(56) References Cited

U.S. PATENT DOCUMENTS

| | | | |
|---|---|---|---|
| 2016/0029439 | A1 | 1/2016 | Kurose et al. |
| 2016/0061490 | A1 | 3/2016 | Cho et al. |
| 2016/0091210 | A1 | 3/2016 | Ceccoli |
| 2016/0095469 | A1 | 4/2016 | Gregory et al. |
| 2016/0116160 | A1 | 4/2016 | Takeuchi |
| 2016/0153666 | A1 | 6/2016 | Tcaciuc |
| 2016/0174768 | A1 | 6/2016 | Deverse |
| 2016/0178209 | A1 | 6/2016 | Park et al. |
| 2016/0178212 | A1 | 6/2016 | Park et al. |
| 2016/0187002 | A1 | 6/2016 | Ryu et al. |
| 2016/0201902 | A1 | 7/2016 | Cadima |
| 2016/0209044 | A1 | 7/2016 | Cadima |
| 2016/0209045 | A1 | 7/2016 | Millius |
| 2016/0295644 | A1 | 10/2016 | Khokle et al. |
| 2016/0296067 | A1 | 10/2016 | Laws |
| 2017/0003033 | A1 | 1/2017 | Lona Santoyo et al. |
| 2017/0067651 | A1 | 3/2017 | Khokle et al. |
| 2017/0074522 | A1 | 3/2017 | Cheng |
| 2017/0082296 | A1 | 3/2017 | Jeong et al. |
| 2017/0082299 | A1 | 3/2017 | Rowley et al. |
| 2017/0108228 | A1 | 4/2017 | Park et al. |
| 2017/0115008 | A1 | 4/2017 | Erbe et al. |
| 2017/0261213 | A1 | 4/2017 | Park et al. |
| 2017/0146247 | A1 | 5/2017 | Lee et al. |
| 2017/0223774 | A1 | 8/2017 | Cheng et al. |
| 2018/0058702 | A1 | 3/2018 | Jang et al. |
| 2018/0299138 | A1 | 10/2018 | Faraldi et al. |

FOREIGN PATENT DOCUMENTS

| | | | |
|---|---|---|---|
| CN | 201680430 | U | 12/2010 |
| DE | 7242625 | | 3/1973 |
| DE | 2845869 | | 4/1980 |
| DE | 3014908 | | 10/1981 |
| DE | 3238441 | A1 | 4/1984 |
| DE | 3446621 | A1 | 6/1986 |
| DE | 3717728 | A1 | 12/1988 |
| DE | 3150450 | C2 | 8/1989 |
| DE | 3839657 | | 5/1990 |
| DE | 4103664 | C1 | 1/1992 |
| DE | 4228076 | | 5/1993 |
| DE | 4445594 | | 6/1996 |
| DE | 10218294 | A1 | 11/2003 |
| DE | 60004581 | T2 | 6/2004 |
| DE | 102004002466 | A1 | 8/2005 |
| DE | 1020040009606 | | 9/2005 |
| DE | 102005059505 | A1 | 6/2007 |
| DE | 19912452 | B4 | 10/2007 |
| DE | 102006034391 | A1 | 1/2008 |
| DE | 102007021297 | A1 | 11/2008 |
| DE | 102008027220 | A1 | 12/2009 |
| DE | 102008042467 | A1 | 4/2010 |
| DE | 102008051829 | A1 | 4/2010 |
| DE | 102009002276 | A1 | 10/2010 |
| DE | 102013218714 | A1 | 4/2014 |
| EP | 0000908 | A1 | 3/1979 |
| EP | 0122966 | | 10/1984 |
| EP | 0429120 | A2 | 5/1991 |
| EP | 0620698 | A1 | 10/1994 |
| EP | 0690659 | A2 | 1/1996 |
| EP | 1030114 | A1 | 8/2000 |
| EP | 1217306 | | 6/2002 |
| EP | 1344986 | A1 | 9/2003 |
| EP | 1586822 | A1 | 10/2005 |
| EP | 1617148 | A1 | 1/2006 |
| EP | 1099905 | B1 | 2/2006 |
| EP | 1201998 | B1 | 3/2006 |
| EP | 1460342 | B1 | 5/2006 |
| EP | 2063181 | A2 | 5/2009 |
| EP | 2063444 | A1 | 5/2009 |
| EP | 2070442 | | 6/2009 |
| EP | 2116775 | A1 | 11/2009 |
| EP | 2116829 | A1 | 11/2009 |
| EP | 2278227 | | 1/2011 |
| EP | 2299181 | A1 | 3/2011 |
| EP | 2375170 | A1 | 10/2011 |
| EP | 2144012 | B1 | 9/2012 |
| EP | 2657615 | | 10/2013 |
| EP | 2816291 | A1 | 12/2014 |
| EP | 2835580 | A2 | 2/2015 |
| EP | 3006832 | A1 | 4/2016 |
| EP | 2848867 | B1 | 9/2017 |
| FR | 2712071 | | 5/1995 |
| FR | 2787556 | A1 | 6/2000 |
| FR | 2789753 | A1 | 8/2000 |
| FR | 3003338 | A1 | 9/2014 |
| GB | 2158225 | A | 11/1985 |
| JP | 2001141244 | A | 5/2001 |
| JP | 2005009693 | A | 1/2005 |
| JP | 2007147131 | A | 6/2007 |
| JP | 2010038475 | A | 2/2010 |
| JP | 2011144982 | A | 7/2011 |
| JP | 2011257021 | A | 12/2011 |
| KR | 1000389410 | | 6/2003 |
| WO | 1991013526 | A1 | 9/1991 |
| WO | 9850736 | A1 | 11/1998 |
| WO | 2006072388 | A1 | 7/2006 |
| WO | 2006136363 | A1 | 12/2006 |
| WO | 2012077050 | A2 | 6/2012 |
| WO | 2013098330 | A2 | 7/2013 |
| WO | 2013104521 | A1 | 7/2013 |
| WO | 2013182410 | | 12/2013 |
| WO | 2014194176 | A1 | 12/2014 |
| WO | 2015086420 | A1 | 6/2015 |

OTHER PUBLICATIONS

True-Heat burner, image post date Jan. 30, 2015, U.S. Appl. No. 29/539,768 in Restriction Requirement dated Oct. 27, 2016, 2 pages, <http://ovens.reviewed.com/news/kitchenaid-has-a-new-flame>.

Metal Cover Gas Hob, image post date 2012, U.S. Appl. No. 29/539,768 in Restriction Requirement dated Oct. 27, 2016, 13 pages, <http://inse.gmc.globalmarket.com/products/details/metal-cover-gas-hob-8516959.html>.

Penny Stove, image post date 2004, U.S. Appl. No. 29/539,768 in Restriction Requirement dated Oct. 27, 2016, 30 pages, <http://www.jureystudio.com/pennystove/stoveinstruction.html>.

* cited by examiner

VENTILATION SYSTEM FOR COOKING APPLIANCE

CROSS-REFERENCE TO RELATED APPLICATION

The present application is a continuation of U.S. patent application Ser. No. 16/018,877 filed Jun. 26, 2018, entitled VENTILATION SYSTEM FOR COOKING APPLIANCE, the entire disclosure of which is hereby incorporated herein by reference.

BACKGROUND

The device is in the field of cooking appliances, and more specifically, a ventilation system for a cooking appliance that utilizes low pressure areas to generate suction for drawing air from one portion of the cooking appliance to another.

SUMMARY

In at least one aspect, a cooking appliance includes a housing having a heating cavity defined therein, wherein a heat source is in thermal communication with the heating cavity. A cooling channel is disposed proximate a sidewall of the housing. A blower selectively operates to move at least cooling air through the cooling channel and to an air outlet. A vent aperture extends through the sidewall between the heating cavity and a ventilation channel. The ventilation channel includes a narrowed portion proximate the vent aperture, wherein during operation of the blower, the narrowed portion defines a low static pressure region of the ventilation channel that draws cavity air from the heating cavity and directs the cavity air into the ventilation channel to be combined with the cooling air.

In at least another aspect, a ventilation system for a cooking appliance includes a housing having a sidewall and a heating cavity defined within the housing. An outer cooling path extends around at least a portion of the housing. A ventilation channel is disposed proximate a sidewall of the housing and at least partially within the outer cooling path. A blower selectively operates to move cavity air through the exhaust channel and to an air outlet. A low pressure space is defined within the cooling path proximate the blower. The ventilation channel extends from the vent aperture and into the low pressure space. The blower contemporaneously draws cooling air through the outer cooling path and cavity air through the ventilation channel. The low pressure space and the ventilation channel maintain the cavity air contained within the ventilation channel to be combined with the cooling air at a downstream location. In at least another aspect, a cooking appliance includes an upper housing that defines an upper heating cavity. A lower housing defines a lower heating cavity. An outer cooling path extends around at least a portion of the upper and lower housings to an air outlet. Upper and lower blowers operate to selectively move cooling air through the outer cooling path. A ventilation channel is at least partially disposed within the outer cooling path. The ventilation channel extends from a vent aperture defined within the upper heating cavity to a downstream location of the outer cooling path. Operation of at least the lower blower contemporaneously moves the cooling air through the outer cooling path and moves cavity air from the upper heating cavity and to the downstream location via the ventilation channel. The cooling air and the cavity air combine at the downstream location.

These and other features, advantages, and objects of the present device will be further understood and appreciated by those skilled in the art upon studying the following specification, claims, and appended drawings.

DETAILED DESCRIPTION OF EMBODIMENTS

Figure 1:
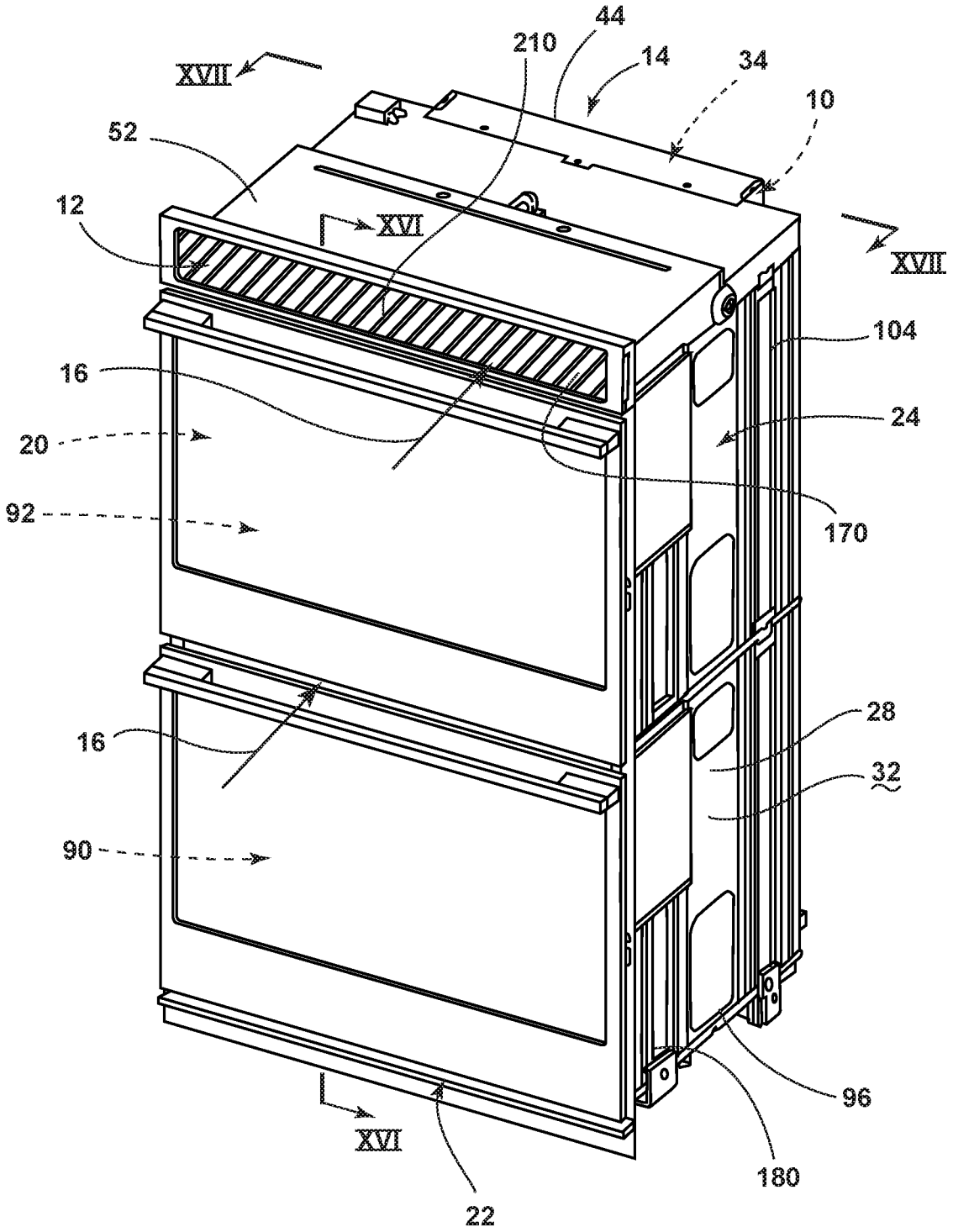
FIG. 1 is a front perspective view of a cooking appliance having upper and lower heating cavities.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-6 and 12, reference numeral 10 generally refers to a cooling channel for a ventilation system 12 of a cooking appliance 14, where the cooling channel 10 serves to move cooling air 16 around portions of the cooking appliance 14. The cooling channel 10 also allows for movement of cavity air 18 from one or more heating cavities 20 and into the cooling channel 10. This cavity air 18 can then be circulated through the ventilation system 12 and removed from the appliance 14 through an air outlet 22 of the ventilation system 12. According to various aspects of the device, the cooking appliance 14 can include a housing 24 having at least one heating cavity 20 defined therein. A heat source 26 is disposed within the housing 24 and is placed in thermal communication with the heating cavity 20. The cooling channel 10 is disposed proximate at least one sidewall 28, typically a back wall 30, of the housing 24 and is typically positioned at or near an exterior surface 32 of the housing 24. A blower 34 for the ventilation system 12 of the cooking appliance 14 is disposed proximate the housing 24. The blower 34 selectively operates to move cooling air 16 through the cooling channel 10 and to the air outlet 22. The cooling channel 10 is typically defined between the housing 24 and a channel cover 44 attached to the housing 24. A vent aperture 36 is positioned within the housing 24 and extends through the sidewall 28 between the heating cavity 20 and a ventilation channel 42.

The ventilation channel 42, in certain aspects of the device, can include a narrowed portion 38 that is positioned near or proximate the vent aperture 36. During operation of the blower 34, the narrowed portion 38 defines a low static-pressure region 40 of the ventilation channel 42. This low static-pressure region 40 serves to draw or suction cavity air 18 from within the heating cavity 20. This suction 82 generated by the low static-pressure region 40 directs the cavity air 18 into the ventilation channel 42 via the vent aperture 36. After leaving the vent aperture 36, the cavity air 18 is combined with the cooling air 16 within the cooling channel 10. In various aspects of the device, the cavity air 18 and the cooling air 16 are combined within a downstream portion 50 of the cooling channel 10. Typically, the ventilation channel 42 is at least partially disposed within the cooling channel 10. The ventilation channel 42 extends from the vent aperture 36 to the downstream location or downstream portion 50. This downstream portion 50 is typically distal from the vent aperture 36, such as an area beneath the housing 24 and near the air outlet 22.

According to various aspects of the device, the ventilation channel 42 is a substantially closed duct that separates the cavity air 18 from the cooling air 16 within the cooling channel 10. The cooling channel 10 serves to cool various components of the appliance 14 that are disposed within the back wall 30 and at least partially disposed within the cooling channel 10. These components can include various heat sources 26 and other portions of the appliance 14. Typically, the cavity air 18 can include grease, debris, particulate matter and other cooking byproducts. These cooking byproducts are ventilated from the heating cavity 20 and the appliance 14. These cooking byproducts also are separated from the heat sources 26 (such as convection fan 290) and other components of the appliance 14 contained within the cooling channel 10. The cooking byproducts can clog or otherwise degrade the performance of these components. Accordingly, the use of the ventilation channel 42 allows for movement of the cavity air 18 through the cooling channel 10, but also maintains the cavity air 18 separate from the cooling air 16 and the components of the appliance 14.

Referring again to FIGS. 2-6, the narrowed portion 38 of the ventilation channel 42 can be defined by a deflecting body 60 that is disposed within the ventilation channel 42. In this manner, the deflecting body 60 is positioned within the ventilation channel 42 and occupies at least a portion of the ventilation channel 42 near the vent aperture 36. The cavity air 18 moving through the ventilation channel 42 and past the deflecting bodies 60 is caused to move faster around the deflecting bodies 60, thereby creating the low static-pressure region 40 in the ventilation channel 42 at the vent aperture 36. This acceleration of the cooling air 16 causes a Venturi-effect section 120 within the ventilation channel 42 that forms the low static-pressure region 40 at the vent aperture 36. As a result of the low static-pressure region 40, cavity air 18 is suctioned from the heating cavity 20 and into the low static-pressure region 40 at the ventilation channel 42 via the vent aperture 36. This suction 82 is generated by the tendency of air in the low static-pressure region 40 to equalize or normalize in static pressure relative to other areas of the ventilation channel 42.

The deflecting bodies 60 that form the narrowed portion 38 of the ventilation channel 42 can be made to have different cross sections that are formed by attaching the deflecting bodies 60 inside the ventilation channel 42. Shapes of the deflecting bodies 60 can include, but are not limited to, triangles, wedges, arcuate shapes, undulating shapes, irregular shapes, combinations thereof, and other similar shapes that can define the narrowed portion 38 of the ventilation channel 42. As discussed above, the narrowed portion 38 of the ventilation channel 42 serves to create a Venturi-effect section 120 within the low static-pressure region 40 that accelerates the cooling air 16 at the vent aperture 36 of the ventilation channel 42. As discussed previously, the low static-pressure region 40 of the ventilation channel 42 creates the Venturi effect that serves to draw cavity air 18 out from the heating cavity 20 and through the vent aperture 36 and into the ventilation channel 42 near the deflecting bodies 60.

Referring again to FIGS. 4-7, according to an exemplary aspect of the device, the deflecting body 60 can include a leading portion 62 that includes a steep transition 64. This leading portion 62 serves to quickly accelerate the cavity air 18 to define the low static-pressure region 40. A trailing portion 66 can be positioned downstream of the leading portion 62 and can include a gradual transition 68. This gradual transition 68 serves to gradually increase the static pressure so that at least some suction 82 is generated along the length of the trailing portion 66 of the deflecting body 60. This gradual transition 68 of the trailing portion 66 also serves to better combine the various streams of cavity air 18, and also serves to better combine the cavity air 18 with the cooling air 16 at the downstream portion 50 in a generally laminar transition 70. The use of the gradual transition 68 of the trailing portion 66 serves to limit the turbulence generated by the movement of the cavity air 18 into the ventilation channel 42. The deflecting body 60 can also include a suction gap 72 that is defined between the leading and trailing portions 62, 66. The suction gap 72 allows for better movement of the cavity air 18 through the vent aperture 36 and into the ventilation channel 42. In this manner, the suction gap 72 can at least partially define the vent aperture 36. In various embodiments, the trailing portion 66 can define a step 74 that is a narrowed top edge 76 of the trailing portion 66. The narrowed top edge 76 steps inward from the leading portion 62 so that the step 74 defines at least a portion of the Venturi-effect section 120 of the vent aperture 36.

According to various aspects of the device, the narrowed portion 38 of the ventilation channel 42 can also be formed through manipulating the shape of boundary walls 80 of the cooling channel 10 in the area of the vent apertures 36. The boundary walls 80 of the cooling channel 10 can be bent or deformed inward or flattened to a thinner profile to form the narrowed portion 38 of the cooling channel 10. Making the cooling channel 10 narrower can result in the low static-pressure region 40 that generates the Venturi-effect section 120 to suction cavity air 18 through the vent aperture 36 and into the ventilation channel 42.

According to the various aspects of the device, where the deflecting body 60 is a separate body installed within the ventilation channel 42, the deflecting body 60 typically surrounds at least a portion of the vent aperture 36. Through this placement, the Venturi effect generated by the deflecting body 60 can cause suction 82 through the vent aperture 36 for drawing cavity air 18 from the heating cavity 20 and into the ventilation channel 42. In various aspects of the device, the amount of suction 82 created in the low static-pressure region 40 can be regulated by the operating speed of the blower 34, or by a pulse-type operation of the blower 34.

Referring again to FIGS. 1-6, 12 and 15-17, the cooking appliance 14 can also include a second or lower heating cavity 90 that is positioned within the housing 24 and typically below the primary or upper heating cavity 92. A secondary or lower vent aperture 94 can serve the lower heating cavity 90 and can extend through the lower housing 96 between the lower heating cavity 90 and the ventilation channel 42. In this manner, the ventilation channel 42 can include a secondary and, typically, a lower narrowed portion 98 disposed near or proximate the lower vent aperture 94. During operation of the blower 34, the lower narrowed portion 98 defines another of the low static-pressure regions 40 of the ventilation channel 42. This second low static-pressure region 40 forms another Venturi-effect section 120 of the ventilation channel 42 that draws secondary cavity air or lower cavity air 100 from the lower heating cavity 90. This lower cavity air 100 is directed from the lower heating cavity 90 and into the ventilation channel 42 via the lower vent aperture 94. This lower cavity air 100 is then combined within the ventilation channel 42 with the cavity air 18 from the upper heating cavity 92. The lower cavity air 100 and the cavity air 18 can then be combined with the cooling air 16 at the downstream portion 50 of the cooling channel 10.

Figure 2:
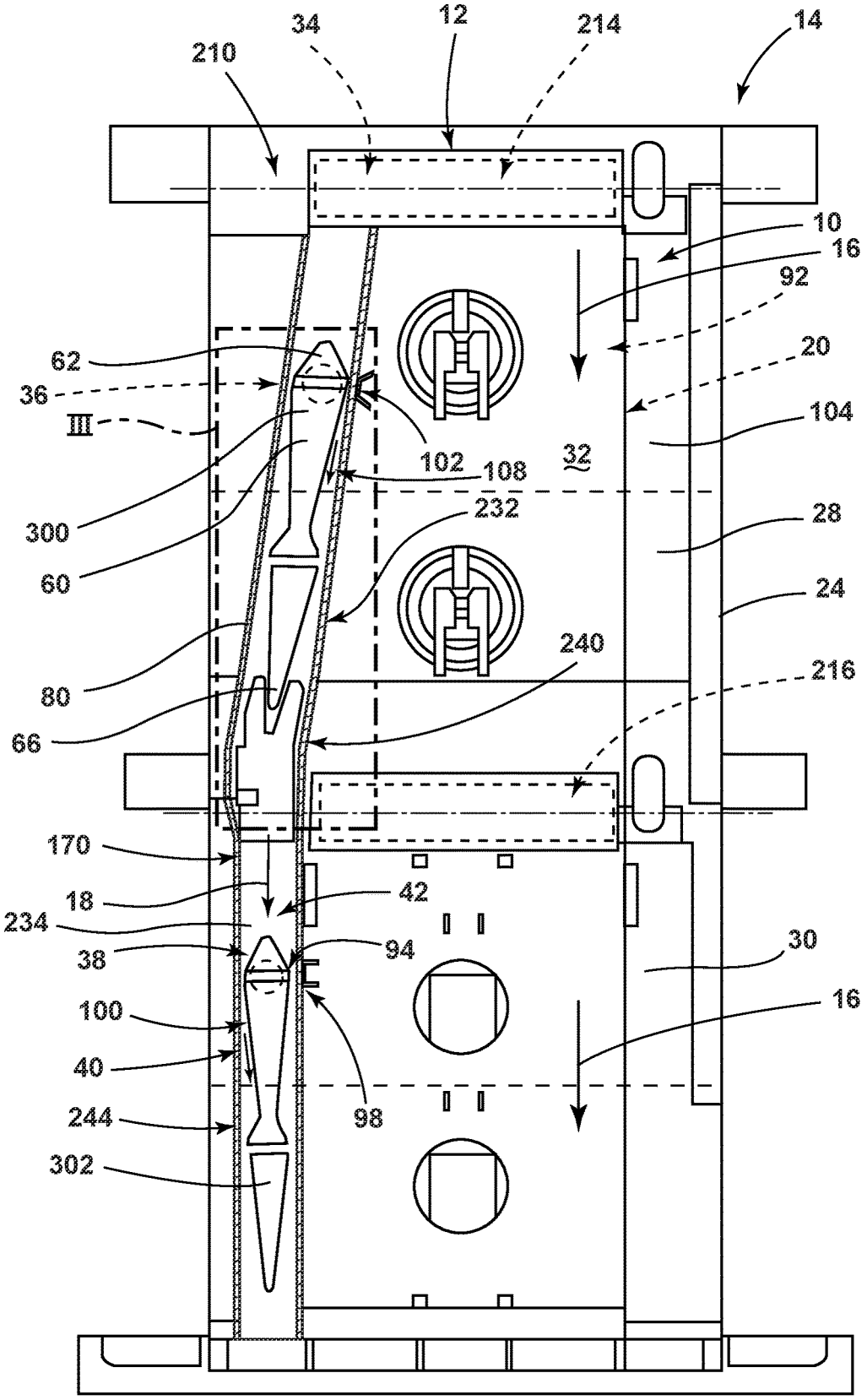
FIG. 2 is a cross-sectional view of a cooling channel for a cooking appliance having four heating cavities.
Figure 3:
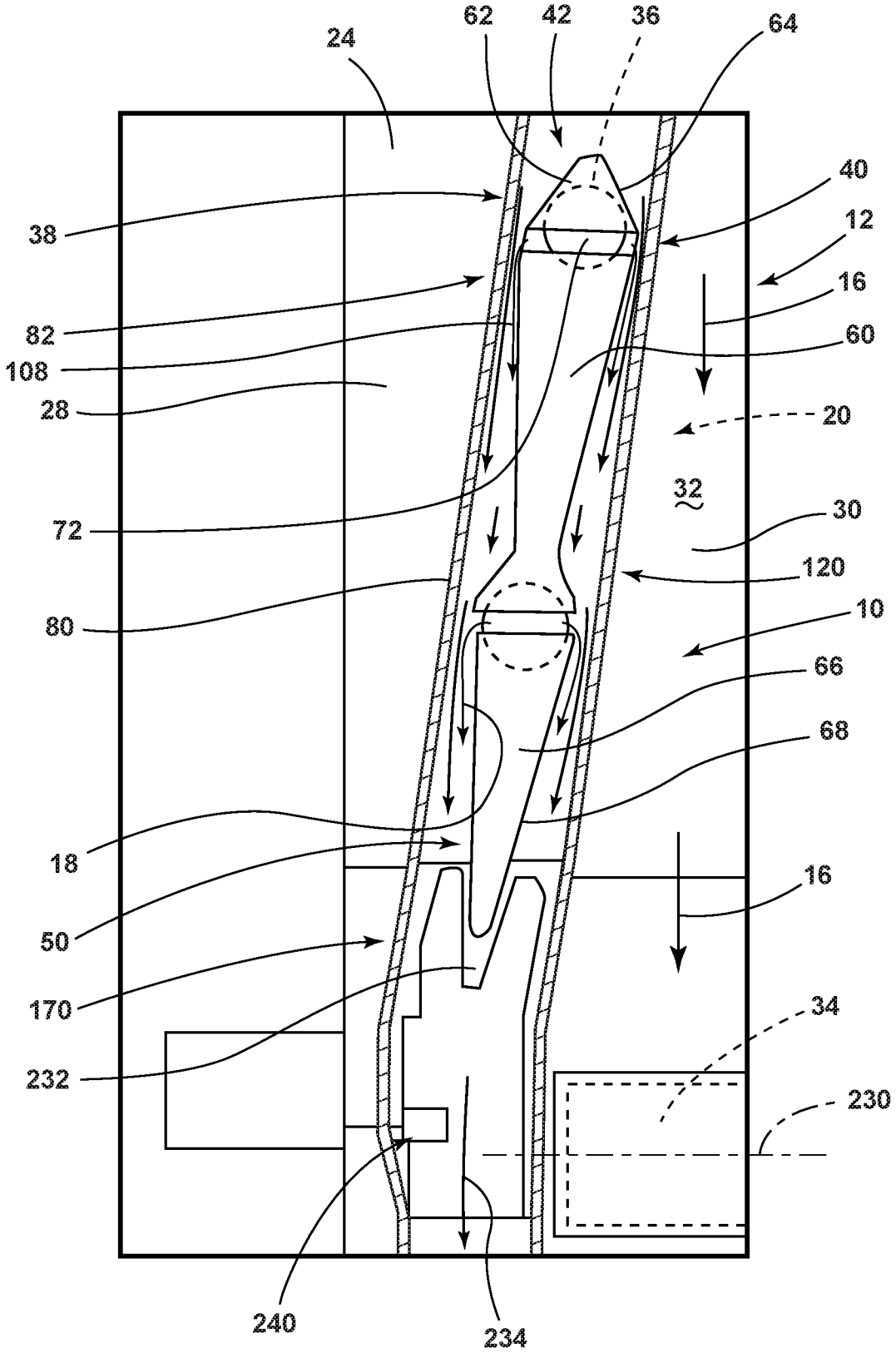
FIG. 3 is an enlarged cross-sectional view of the cooking appliance of FIG. 2 taken at area III.
Figure 4:
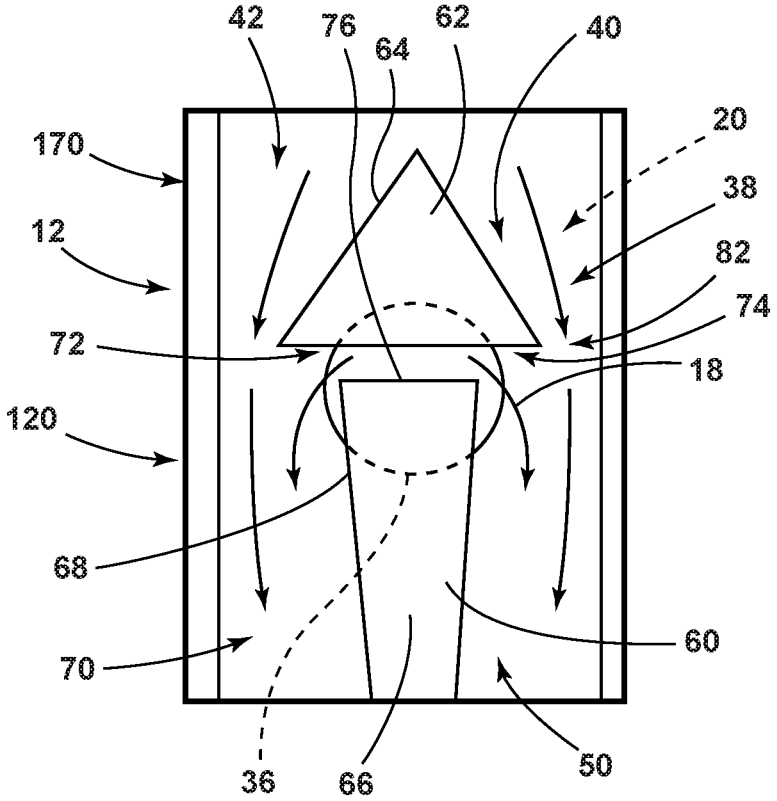
FIG. 4 is a schematic elevational view of a narrowed portion of the ventilation channel positioned near a vent aperture of a heating cavity.
Figure 5:
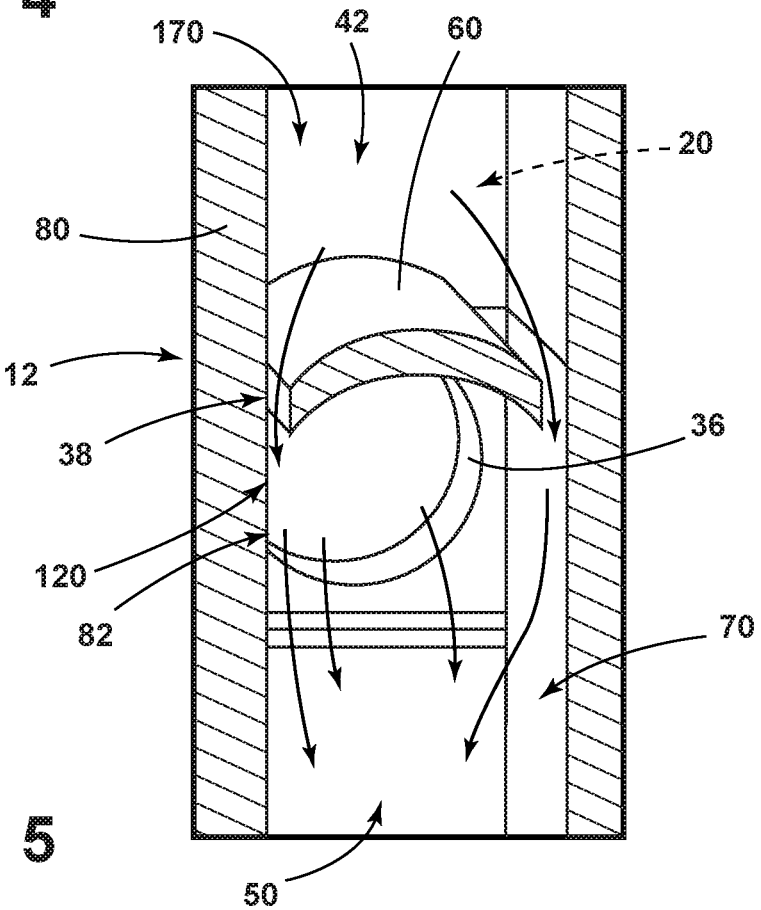
FIG. 5 is a schematic perspective view of an aspect of the narrowed portion of the ventilation channel.
Figure 6:
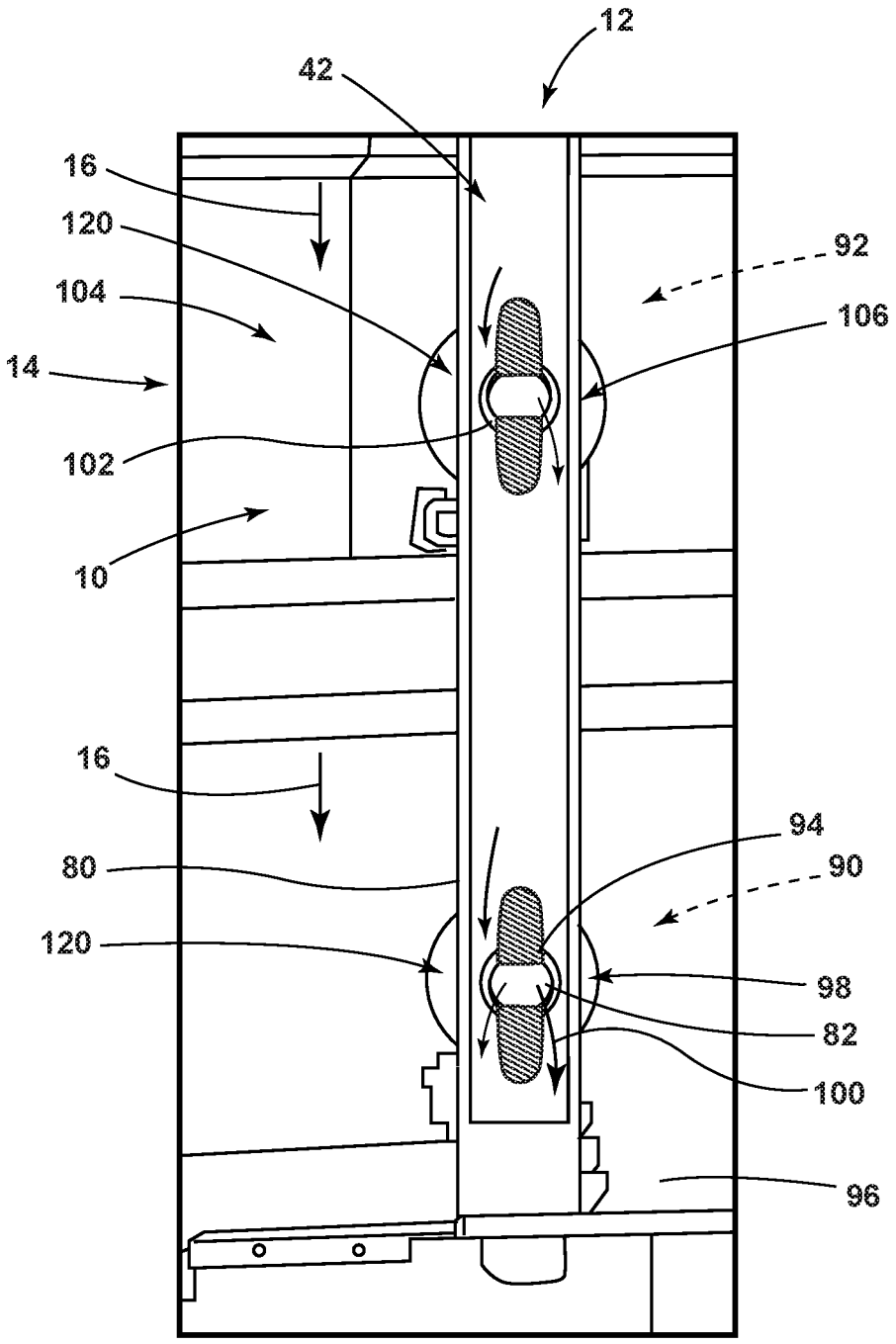
FIG. 6 is an enlarged elevational view of a ventilation channel for a cooking appliance and showing upper and lower vent apertures that draw air from upper and lower heating cavities.
Figure 7:
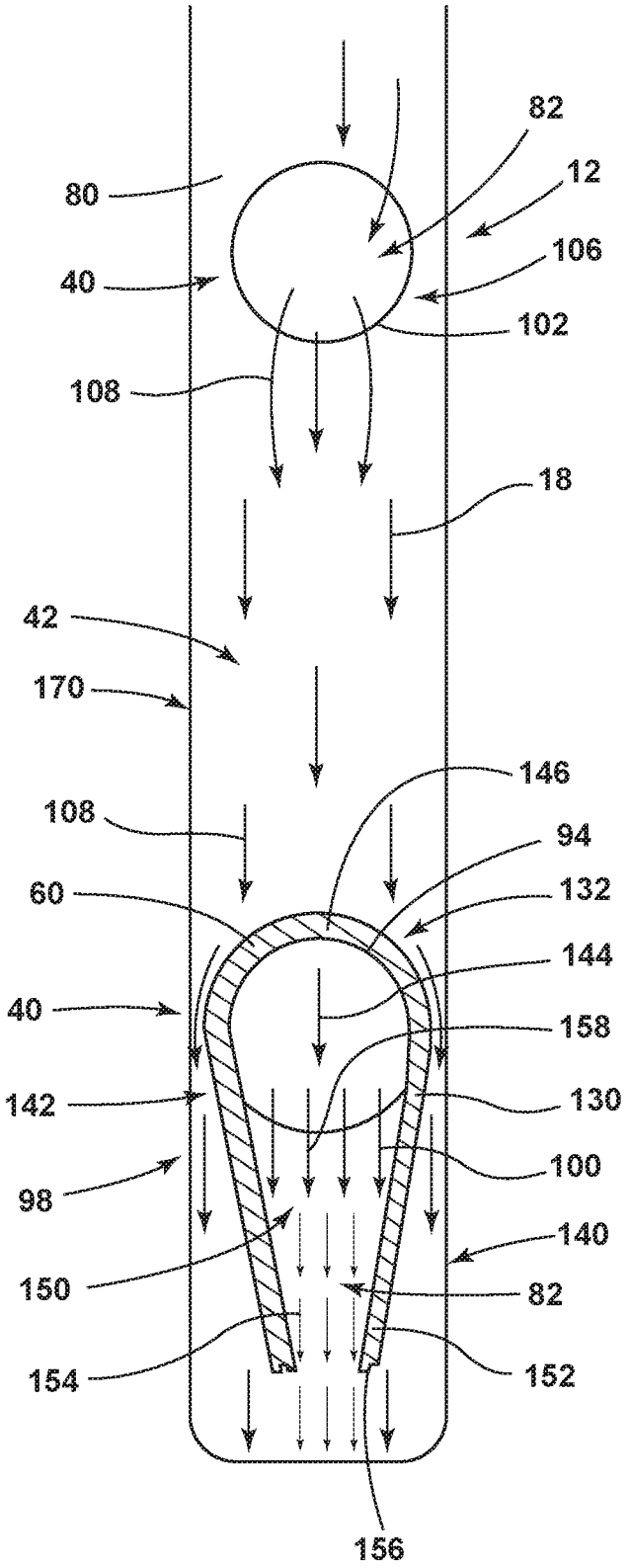
FIG. 7 is a schematic diagram illustrating operation of the narrowed portion of the vent channel during operation of the upper and lower heating cavities.
Figure 8:
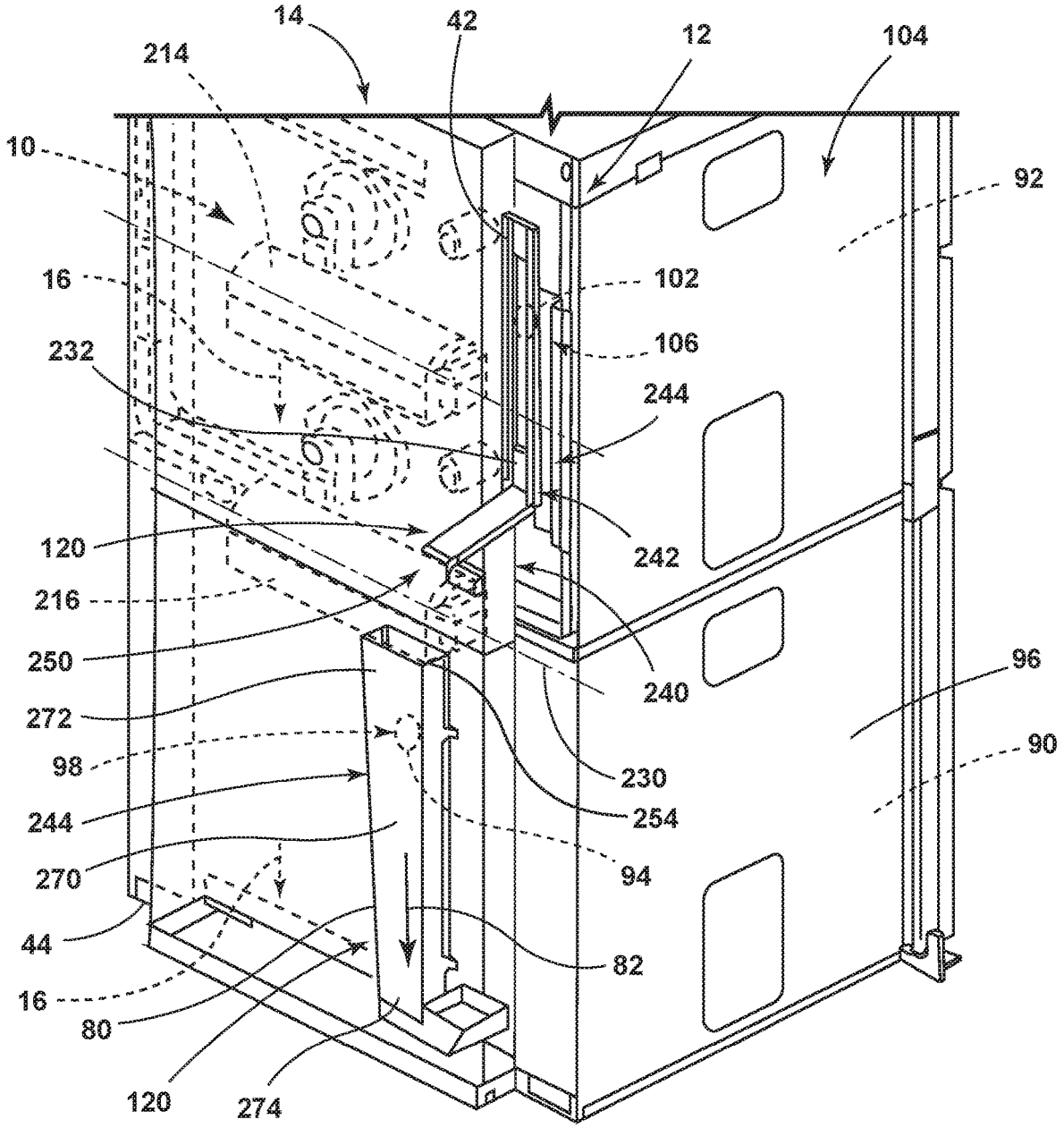
FIG. 8 is a rear perspective view of an aspect of the cooking appliance and incorporating a ventilation channel having a transition portion disposed between the upper and lower heating cavities.
Figure 9:
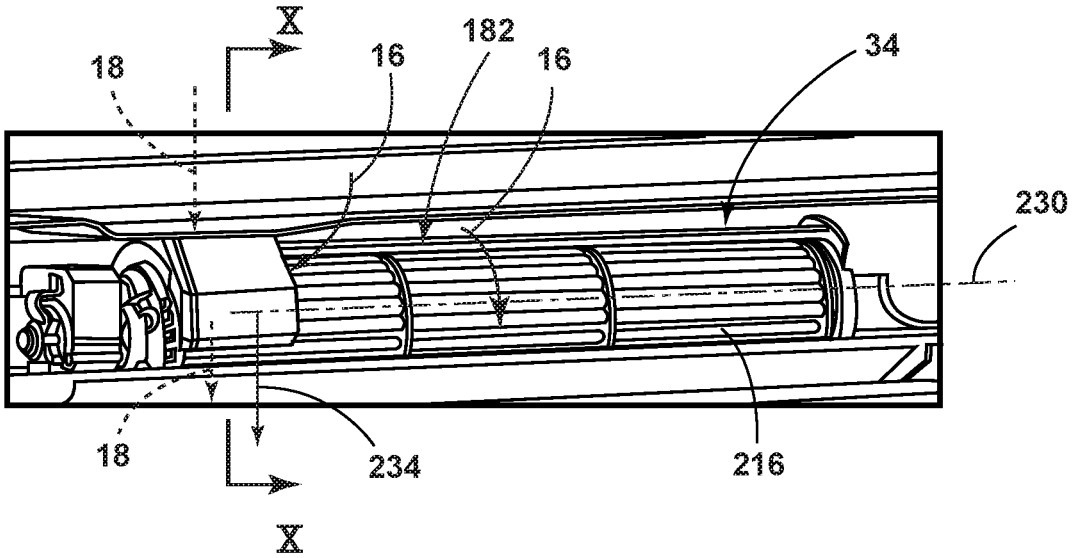
FIG. 9 is a rear perspective view of an aspect of the blower incorporated within an aspect of the transition portion of the ventilation channel for a cooking appliance.
Figure 10:
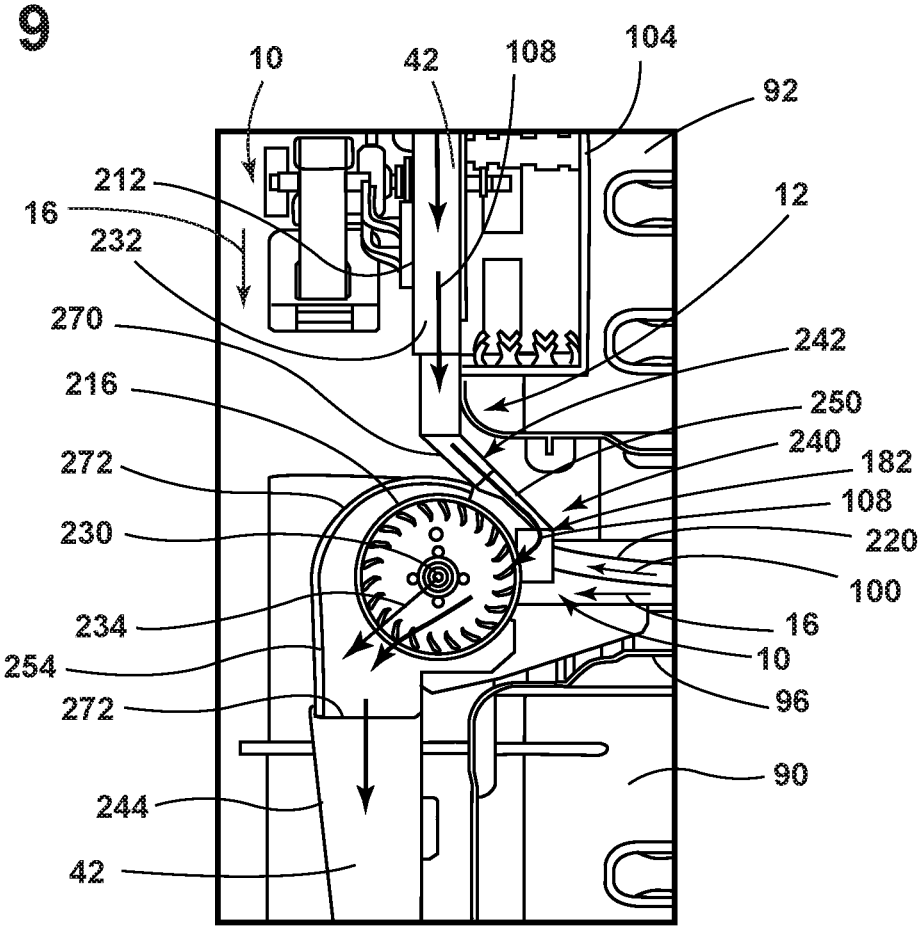
FIG. 10 is a cross-sectional view of the transition portion of the ventilation channel of FIG. 9 taken at line X-X.

According to the various aspects of the device, the ventilation channel 42 extends continuously between the upper vent aperture 102 and the lower vent aperture 94 and corresponding upper and lower narrowed portions 106, 98. Accordingly, the cooking appliance 14 typically includes a single ventilation channel 42 that serves each of the upper heating cavity 92 and lower heating cavity 90, which can also be referred to as the upper and lower heating cavities 92, 90 of a dual-cavity oven. This principle can also be expanded to additional heating cavities 20 where a particular cooking appliance 14 can include three or more heating cavities 20. In an exemplary embodiment, four heating cavities 20 are shown in FIG. 2. In such an embodiment, the ventilation channel 42 extends past each vent aperture 36 of the various heating cavities 20. Accordingly, the cooking byproducts from the various heating cavities 20 are separated from the remainder of the cooling channel 10, and, in turn, the cooling air 16 and the various components of the appliance 14 that are cooled by the cooling air 16. While the heating cavities 20 are described herein as vertically oriented, horizontal orientations of heating cavities 20 and other directional orientations are contemplated.

Referring again to FIGS. 1-6, 12 and 15-17, where multiple heating cavities 20 are included within the cooking appliance 14, the ventilation channel 42 can extend past each vent aperture 36 and corresponding narrowed portions 38 of the various heating cavities 20. In the various aspects of the device, a single blower 34 can be utilized within the cooking appliance 14 to move cavity air 18 through the ventilation channel 42. In certain embodiments, a single blower 34 can be used to move cavity air 18 through several vent apertures 36 and corresponding narrowed portions 38. While an appliance 14 having multiple heating cavities 20 will typically have multiple blowers 34, one of these blowers 34 may be utilized for removing cavity air 18 from the heating cavities 20 and into the ventilation channel 42 that serves several corresponding heating cavities 20. It is also contemplated that multiple blowers 34 can be used to move cavity air 18 from multiple heating cavities 20 through the single ventilation channel 42. Where multiple blowers 34 are used, each blower 34 is typically positioned at separate positions of the ventilation channel 42 or can be connected to separate and dedicated ventilation channels 42. These separate and dedicated ventilation channels 42 are disposed within the cooling channel 10 and terminate at the downstream portion 50 of the cooling channel 10. Typically a single blower 34 will serve a common ventilation channel 42 that can provide for efficient movement of the various streams of cavity air 18 that are drawn or suctioned from the various heating cavities 20 of the appliance 14 and moved to the downstream portion 50 to be combined with the cooling air 16 in the cooling channel 10.

Figure 15:
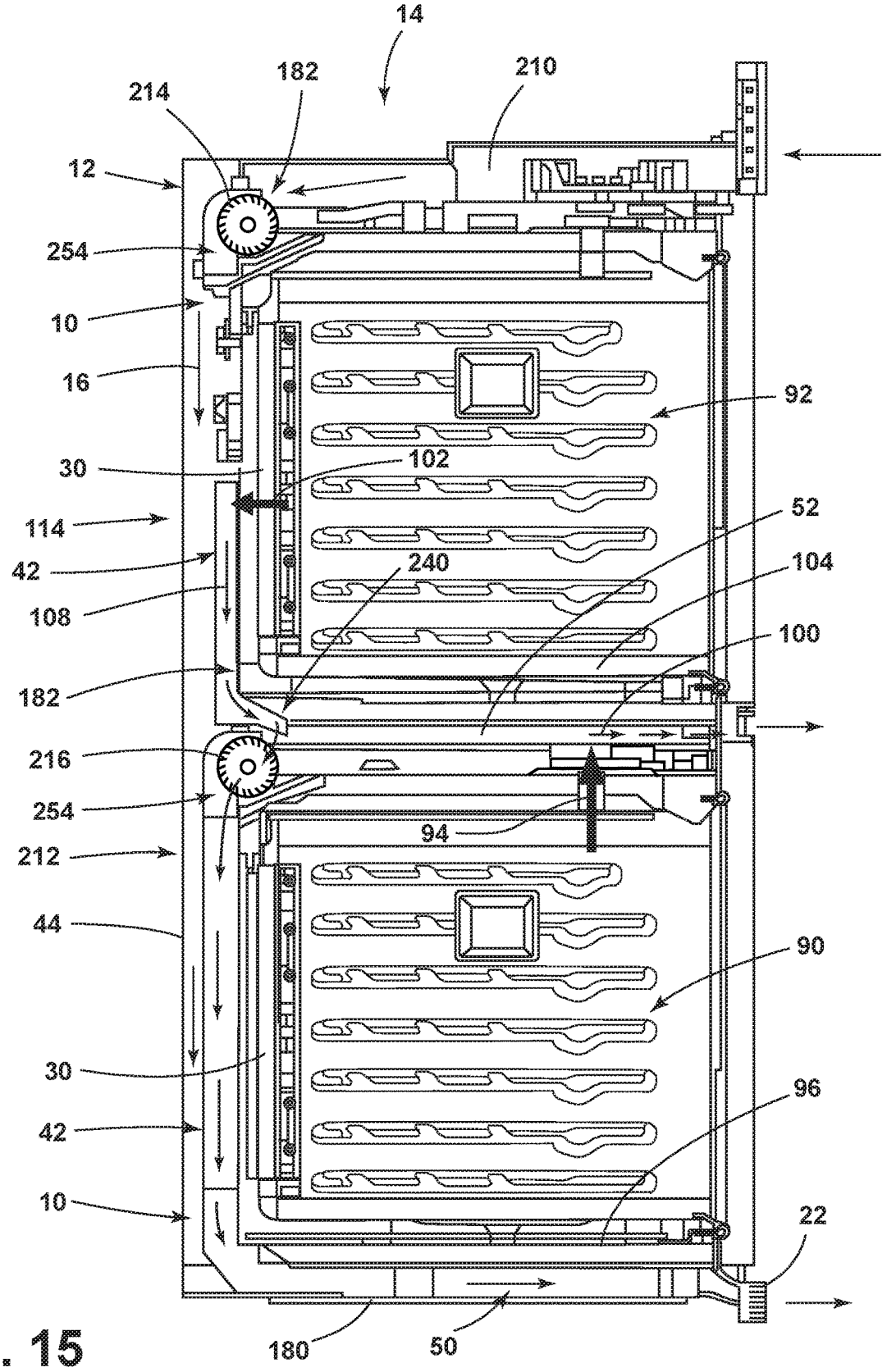
FIG. 15 is a cross-sectional view of a cooking appliance showing a ventilation channel that is operated by only one blower.
Figure 16:
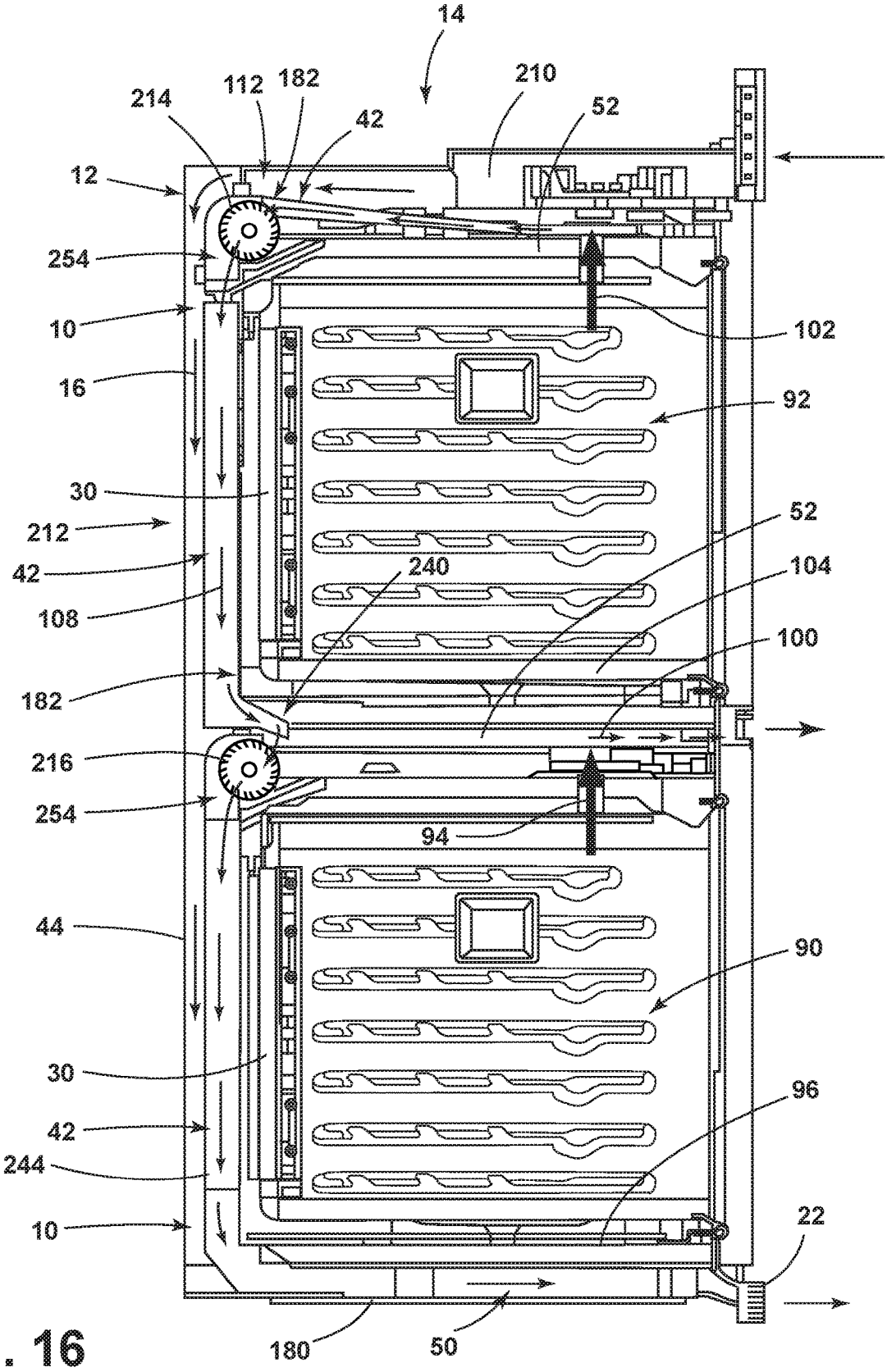
FIG. 16 is a cross-sectional view of the cooking appliance of FIG. 1, taken along line XVI-XVI.
Figure 17:
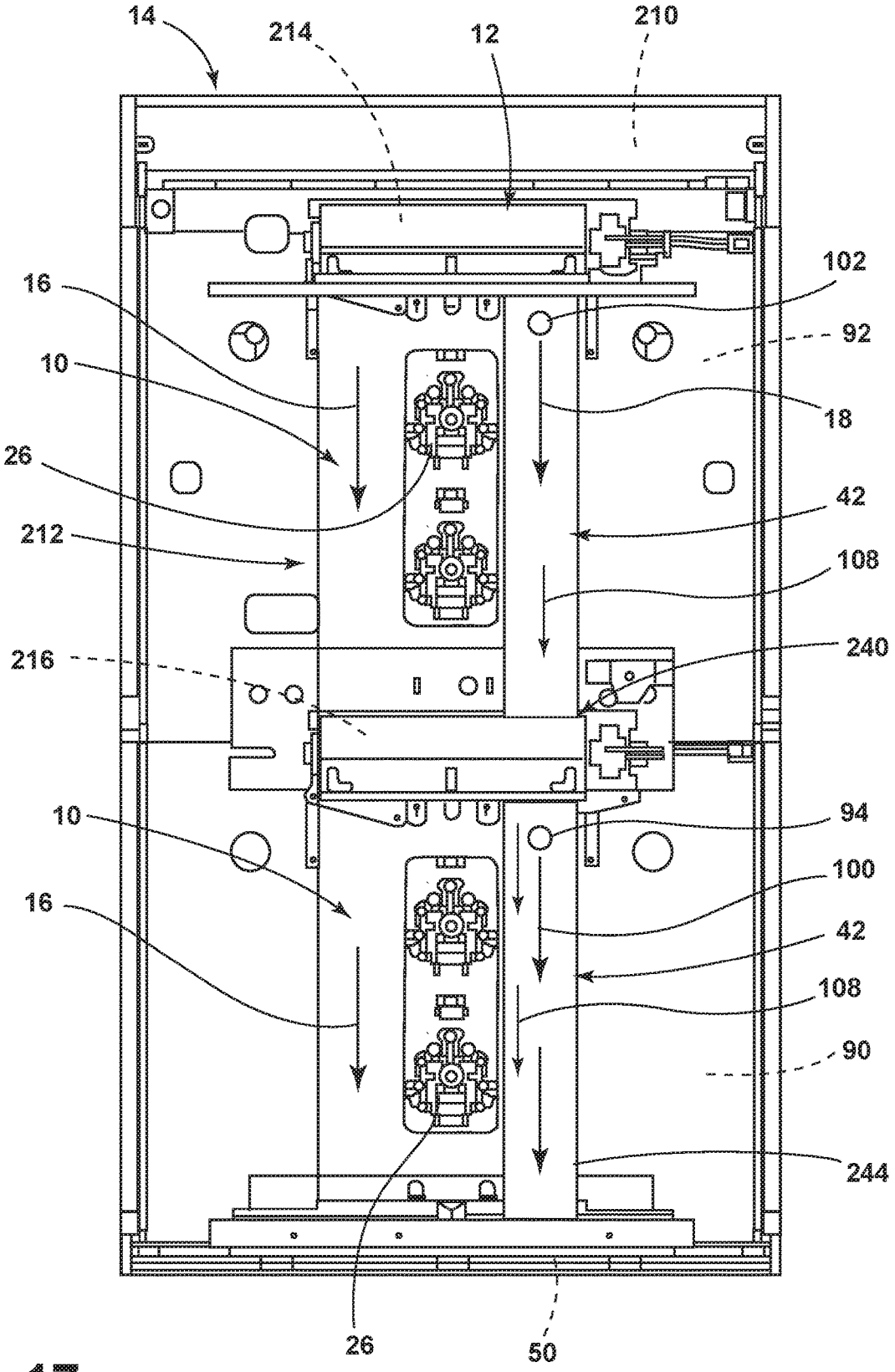
FIG. 17 is a cross-sectional view of the cooking appliance of FIG. 1, taken along line XVII-XVII.

In various aspects of the device, as exemplified in FIGS. 15-17, the various heating cavities 20 typically include a vent aperture 36 that leads into the ventilation channel 42. The vent aperture 36 can be positioned within a top wall 52 of the heating cavity 20. The ventilation channel 42 then extends from the vent aperture 36 within the top wall 52 and extends through the ventilation channel 42 and into the low pressure space 182 of the corresponding blower 34. This configuration can be referred to as a top-reverse configuration 112 where the cavity air 18 is moved through the top wall 52 of the heating cavity 20 and toward the remainder of the ventilation channel 42 that is positioned near the back wall 30 of the appliance 14. In other aspects of the appliance 14, the vent aperture 36 can be located within a back wall 30 of the heating cavity 20. During operation of a blower 34, cavity air 18 is moved through the vent aperture 36 in the back wall 30 and is moved through the ventilation channel 42 toward a low pressure space 182 of a blower 34 positioned below the heating cavity 20. This configuration can be referred to as a back-reverse configuration 114.

In the top-reverse configuration 112, the blower 34 that serves the respective heating cavity 20 forms the low pressure space 182 that moves the cavity air 18 from the respective heating cavity 20. This configuration is typically seen in appliances 14 that have a single heating cavity 20 as well as other configurations. The back-reverse configuration 114 is typically found in appliances 14 having at least an upper heating cavity 92 and a lower heating cavity 90. In the back-reverse configuration 114, the lower blower 216 serves to draw cavity air 18 from the upper heating cavity 92. In this configuration, the vent aperture 36 within the upper heating cavity 92 is positioned within a back wall 30 of the upper heating cavity 92. The ventilation channel 42 extends from the vent aperture 36 within the back wall 30 of the upper heating cavity 92 and extends downward to the low pressure space 182 of the lower blower 216. The lower blower 216 then moves the cavity air 18 from the upper heating cavity 92 through the remainder of the ventilation channel 42 and toward the air outlet 22 for the appliance 14.

According to various aspects of the device, where the appliance 14 includes multiple heating cavities 20, the various heating cavities 20 can include different ventilation configurations. These ventilation configurations can include the top-reverse configuration 112 or the back-reverse configuration 114 described above. In an appliance 14 having multiple heating cavities 20, one of the heating cavities 20 may include a conventional forward ventilation configuration that is known in the art. The remaining heating cavities 20 will typically include the back-reverse configuration 114, the top-reverse configuration 112, or a variation of these novel configurations, as disclosed herein. In various aspects of the device, it is also contemplated that one of the heating cavities 20 may include no vent apertures 36.

Referring now to FIGS. 4-7, various aspects of the cooking appliance 14 can include upper and lower heating cavities 92, 90 that are served by respective upper and lower vent apertures 102, 94. During operation of the blower 34 for the ventilation system 12, the narrowed portions 38 of the ventilation channel 42 can create a Venturi-effect section 120 of the ventilation channel 42 at each of the upper and lower vent apertures 102, 94. In this configuration, upper cavity air 108 is drawn from the upper heating cavity 92 and through the upper vent aperture 102. This upper cavity air 108 is then moved through the narrowed portion 38 of the ventilation channel 42 at the lower vent aperture 94. The lower vent aperture 94 can include a deflecting body 60 in the form of a cover member 130 that extends around at least a portion of the lower vent aperture 94. This cover member 130 can include an aerodynamic deflector 132 that diverts upper cavity air 108 from the upper heating cavity 92 to defect around the lower vent aperture 94 at the lower heating cavity 90. The aerodynamic deflector 132 also generates the low static-pressure region 40 at the lower vent aperture 94.

Referring again to FIGS. 4-7, this aerodynamic deflector 132 extends downstream of the lower vent aperture 94 and serves to prevent infiltration of upper cavity air 108 into the lower vent aperture 94. In this manner, various particles, fumes, debris, and other cooking byproducts that may be contained within the upper cavity air 108 are prevented from entering into the lower heating cavity 90 via the lower vent aperture 94. Infiltration of the upper cavity air 108 infiltrating into the lower vent aperture 94 may occur in instances when a door of the upper heating cavity 92 is rapidly closed or slammed. This rapid closure of the door can increase the air pressure within the ventilation channel 42. This increased air pressure may tend the upper cavity air 108 toward the lower vent aperture 94. Using the aerodynamic deflector 132 that extends around the lower vent aperture 94, contamination between the upper and lower heating cavities 92, 90 can be substantially eliminated or kept to a minimum through the use of the aerodynamic deflector 132.

Referring again to FIG. 7, the aerodynamic deflector 132 surrounds the lower vent aperture 94 and includes a tapered transition 140 that defines the low static-pressure region 40 and generates Venturi-effect suction 82 that serves to introduce lower cavity air 100 from the lower heating cavity 90. The lower cavity air 100 then combines with the upper cavity air 108 and subsequently combines with the remainder of cooling air 16 at a position downstream of the lower vent aperture 94. This tapered transition 140 of the aerodynamic deflector 132 forms an accelerated air region 142 that utilizes the Venturi effect to promote the suction 82 or outflow of lower cavity air 100 from the lower heating cavity 90 through the lower vent aperture 94 and into the ventilation channel 42. This tapered transition 140, as discussed above, also prevents the inflow of upper cavity air 108 into the lower vent aperture 94.

Referring again to FIG. 7, the use of the aerodynamic deflector 132 also creates a pressure differential between the areas within and areas around the aerodynamic deflector 132. This tapered transition 140 can assist in creating one of low static-pressure regions 40 near the lower vent aperture 94. In this manner, the lower cavity air 100 moves through the lower vent aperture 94 and moves in an exhaust direction 144 to combine with upper cavity air 108 from the upper vent aperture 102. These streams of upper and lower cavity air 108, 100 are then moved to the downstream portion 50 of the cooling channel 10 and are combined with the cooling air 16 that is moved toward the air outlet 22. According to various aspects of the device, the aerodynamic deflector 132 typically includes an upper deflecting section 146 that leads into the tapered transition 140. This upper deflecting section 146 generates a low static-pressure region 40 in the area outside the tapered transition 140.

The low static-pressure region 40 assists in drawing air from the lower vent aperture 94 and also assists in forming an air curtain 154 that prevents infiltration of upper cavity air 108 into the lower vent aperture 94. It is also contemplated that the aerodynamic deflector 132 positioned at the lower vent aperture 94 can extend the full depth of the ventilation channel 42. In this manner, the area defined inside of the aerodynamic deflector 132 that includes the lower vent aperture 94 and the tapered inside portion 150 can be substantially contained inside the aerodynamic deflector 132. A tapered outlet 156 at the end of the outlet extension 152 may provide the only aperture through the aerodynamic deflector 132 into the ventilation channel 42. In this manner, the aerodynamic deflector 132 creates a suction path 158 that extends from inside the lower heating cavity 90, through the lower vent aperture 94 and through the tapered inside portion 150 of the aerodynamic deflector 132 and out the tapered outlet 156 of the aerodynamic deflector 132. Again, this region formed by the aerodynamic deflector 132 prevents infiltration of upper cavity air 108 into the lower vent aperture 94 and into the lower heating cavity 90.

Referring now to FIGS. 1-8, the ventilation system 12 for the cooking appliance 14 can include the housing 24 that surrounds at least one heating cavity 20, where the housing 24 includes a sidewall 28 that at least partially defines one or more heating cavities 20. The outer ventilation path 170 that includes the cooling channel 10 extends around at least a portion of the exterior surface 32 of the housing 24. Again, the cooling channel 10 is typically disposed proximate the sidewall 28 of the housing 24 and at the exterior surface 32 of the housing 24 and is covered by a channel cover 44 attached to the housing 24. The blower 34 for the ventilation system 12 is selectively operable to move cooling air 16 through the cooling channel 10 and to the air outlet 22.

Referring again to FIGS. 1-6, 12 and 15-17, typically, the air outlet 22 is positioned at a base 180 of the housing 24 and directs air outward from the cooking appliance 14. At least one low static-pressure region 40 is defined within the cooling channel 10 at each blower 34. Each blower 34 defines a low pressure space 182 within the area where cooling air 16 enters into the blower 34. The ventilation channel 42 extends from the vent aperture 36 and into the low pressure space 182. In this manner, the ventilation channel 42 utilizes this low pressure space 182 to draw cavity air 18 from the heating cavity 20, through the vent aperture 36 and toward the blower 34. Accordingly, the low pressure space 182 generated by the blower 34 draws cooling air 16 through the cooling channel 10 and contemporaneously or simultaneously draws cavity air 18 through the ventilation channel 42.

In various aspects of the device, the low static-pressure region 40 supplements the low pressure space 182 of the blower 34. As discussed above, the low static-pressure region 40 includes a vent aperture 36 that extends through the sidewall 28 between the heating cavity 20 and the ventilation channel 42. The narrowed portion 38 of the ventilation channel 42 at least partially defines the low static-pressure region 40. The low static-pressure region 40 works in conjunction with the low pressure space 182 of the blower 34 to selectively draw or suction cavity air 18 from the heating cavity 20 and into the low static-pressure region 40 of the ventilation channel 42 via the vent aperture 36. The cavity air 18 that is suctioned from the heating cavity 20 combines with the cooling air 16 in the cooling channel 10 and typically at a downstream portion 50 of the cooling channel 10.

In certain embodiments of the device, as exemplified in FIGS. 12 and 15-17, the ventilation system 12 for the appliance 14 can serve the second heating cavity 20 that is positioned within the housing 24 and typically below the primary heating cavity 20. Again, these can be referred to as the upper and lower heating cavities 92, 90 that are disposed within the housing 24. A lower vent aperture 94 extends through the housing 24 between the lower heating cavity 90 and the ventilation channel 42 that is disposed within the cooling channel 10. The ventilation channel 42 includes the lower narrowed portion 98 that is disposed proximate or near the lower vent aperture 94. The lower narrowed portion 98 selectively defines one of the low static-pressure regions 40 of the ventilation channel 42. This low static-pressure region 40, in conjunction with the low pressure space 182 of the blower 34, serves to draw or suction lower cavity air 100 from the lower heating cavity 90 and directs the lower cavity air 100 into the ventilation channel 42 via the lower vent aperture 94. In this manner, the lower cavity air 100 is combined with the upper cavity air 108 from the upper heating cavity 92. These streams of upper and lower cavity air 108, 100 are then combined with the cooling air 16 at the downstream portion 50 of the cooling channel 10. As discussed above, the use of the narrowed portions 38 of the ventilation channel 42 operate with the blower 34 to generate the lower static-pressure regions 40 that can be repeated for various numbers and configurations of heating cavities 20.

Figure 11:
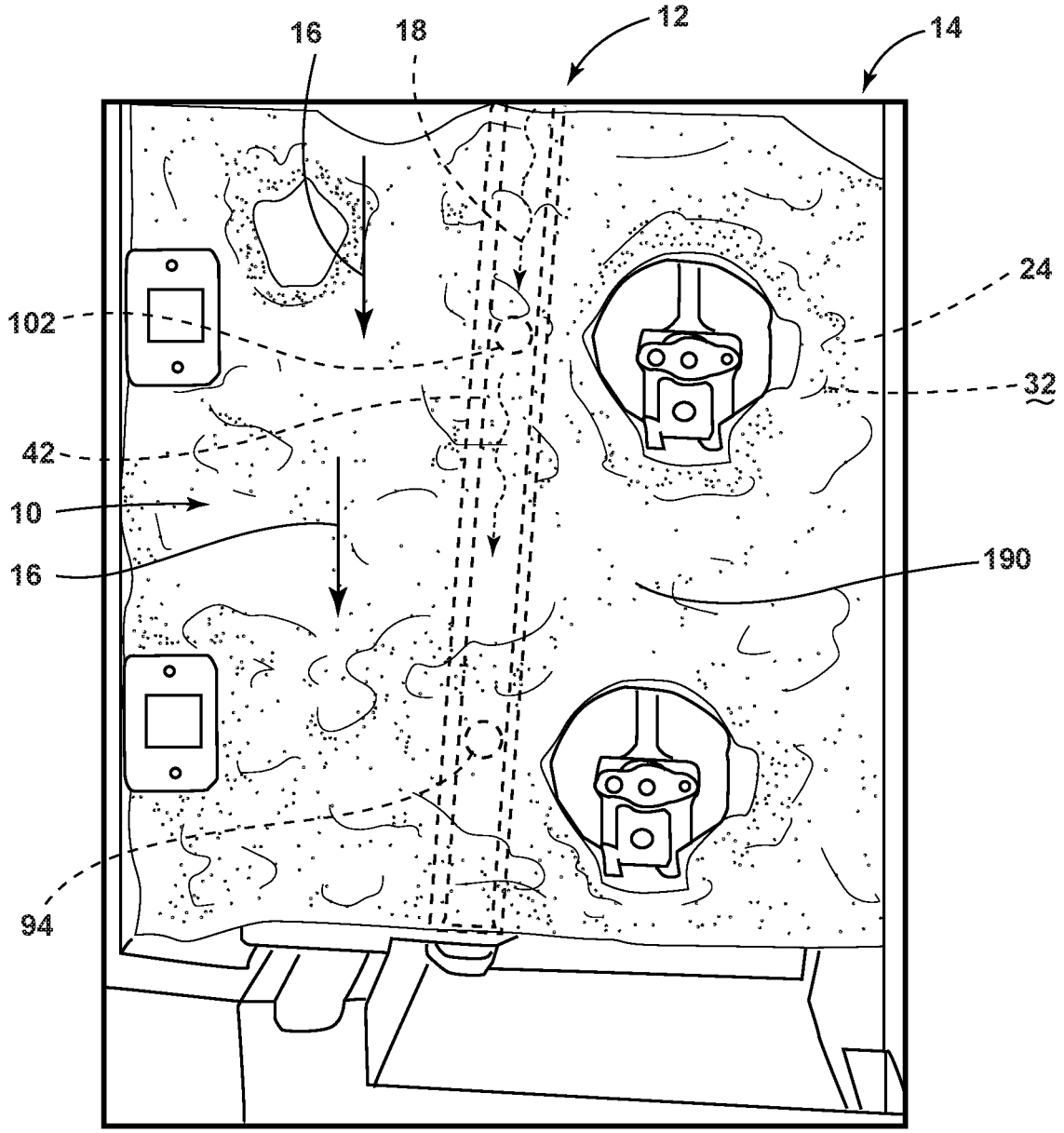
FIG. 11 is a rear elevational view of a cooking appliance showing the ventilation channel positioned below the insulating material of a cooling channel.
Figure 12:
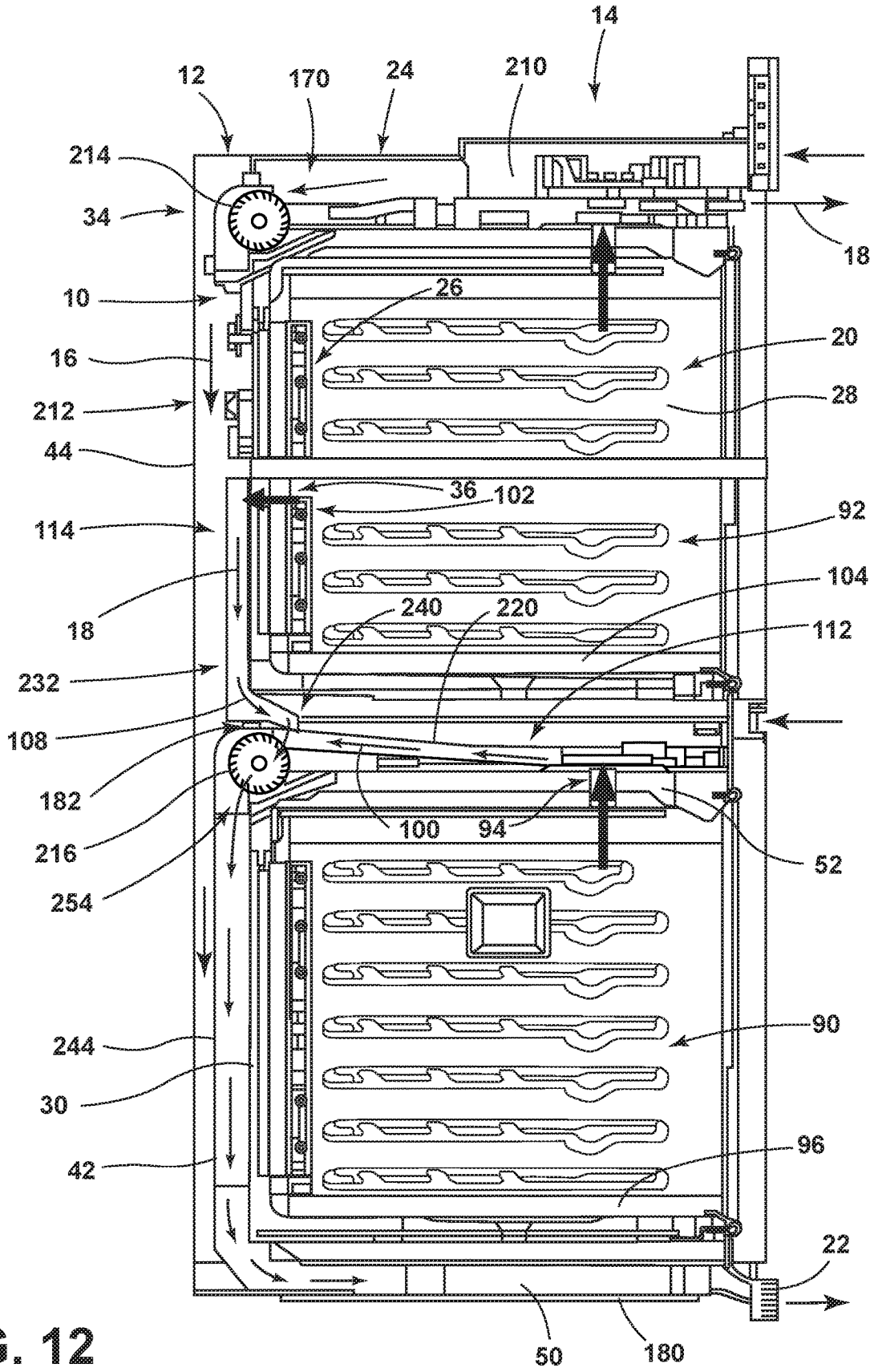
FIG. 12 is a cross-sectional view of a cooking appliance having three heating cavities.

Referring now to FIG. 11, in certain aspects of the device, portions of the ventilation system 12, and in particular, the ventilation channel 42 can be positioned within the cooling channel 10 and between an exterior of the sidewall 28 of the housing 24 and an insulation layer 190 that is positioned within the cooling channel 10. This insulation layer 190 serves to limit the transfer of heat between the ventilation channel 42 and the cooling air 16 within the remainder of the cooling channel 10. Noise from the one or more blowers 34, various convection fans 290, the cooling channel 10, heat sources 26, and other aspects of the cooking appliance 14 can also be dampened through the inclusion of the insulation layer 190 that surrounds at least a portion of the ventilation channel 42.

Referring again to FIGS. 2, 11 and 12, the positioning of the ventilation channel 42 between the housing 24 and the insulation layer 190 maintains the upper and lower cavity air 108, 100 at a relatively consistent temperature. The use of the insulation layer 190 prevents significant heat loss with respect to the upper and lower cavity air 108, 100 and the cooling air 16. Cooling of this air may result in condensation forming within the cooling channel 10 and the ventilation channel 42. By including the insulation layer 190 that extends around the ventilation channel 42, the temperature of the cooling air 16 and the upper and lower cavity air 108, 100 can be maintained in a substantially consistent level to prevent this condensation from occurring. This also prevents condensation for forming, within, on and around the components of the ventilation system 12 for the appliance 14. Additionally, cool air that may be located around the insulation layer 190 and within the cooling channel 10 is substantially prevented from causing a transfer of thermal energy from the ventilation channel 42 through the insulation layer 190 and to the outer areas of the cooling channel 10 surrounding the insulation layer 190. Again, by maintaining the cooling air 16 within the cooling channel 10 and the upper and lower cavity air 108, 100 within the ventilation channel 42, at a relatively consistent temperature, condensation within and around the ventilation system 12 can be kept a minimum or substantially prevented.

According to various aspects of the device, the insulation layer 190 can be made of batting-type insulation, roll-type insulation, foam-insulation, spray-insulation, combinations thereof, and other similar insulating materials.

Referring now to FIGS. 2 and 8-12, the ventilation system 12 for the cooking appliance 14 includes an outer ventilation path 170 that extends around the housing 24 and that can include the cooling channel 10. This outer ventilation path 170 can draw cooling air 16 from a superior portion 210 of the outer ventilation path 170 that is typically positioned above the upper heating cavity 92. The cooling air 16 can be recirculated air that is located around the housing 24 or can be fresh air collected from in front of the heating appliance 14. The movement of the cooling air 16 through the outer ventilation path 170 is generated by the low pressure space 182 of the blower 34. During operation of the blower 34, the low pressure space 182 draws or suctions cooling air 16 into and through the blower 34. The cooling air 16 can then be moved through the blower 34 and to a rearward portion 212 of the housing 24 and toward the air outlet 22. As discussed above, the ventilation channel 42 also utilizes the low pressure space 182 of the blower 34. The ventilation channel 42 extends into low pressure space 182. During operation of the blower 34, the low pressure space 182 contemporaneously draws cooling air 16 from the superior portion 210 and draws cavity air 18 through the vent aperture 36 and into the ventilation channel 42. The cavity air 18, which is substantially separated from the cooling air 16, moves into the ventilation channel 42 to be moved past each of the upper and lower vent apertures 102, 94 and respective narrowed portions 38 that generate the low static-pressure regions 40.

As discussed above, the ventilation system 12 can include a single blower 34 that moves cooling air 16 through the cooling channel 10 and contemporaneously moves cavity air 18 through the ventilation channel 42. The ventilation system 12 can also include multiple blowers 34 such as an upper and lower blower 214, 216 that cooperate selectively to move cooling air 16 through various portions of the outer ventilation path 170. Where two blowers 34 are present, an upper blower 214 can typically draw cooling air 16 around the upper housing 104. The lower blower 216 will typically be dedicated for use with respect to the lower housing 96 such that cooling air 16 is drawn by the lower blower 216 around the lower housing 96. In embodiments utilizing multiple blowers 34, it is contemplated that the upper and lower blowers 214, 216 can operate individually or in concert to move cavity air 18 through the ventilation channel 42 and to also create the low static-pressure regions 40 that are formed through the narrowed portions 38 of the ventilation channel 42.

Referring again to FIGS. 2, 8-12 and 15-17, the one or more blowers 34 of the ventilation system 12 for the cooking appliance 14 can be in the form of a cross flow blower 34. A cross flow blower 34 typically operates along a horizontal rotational axis 230 and draws air from an upstream region 232 and directs that air through operation of the blower 34, typically in a different angular direction 234 normal to the rotational axis 230 of the cross flow blower 34. As discussed above, the cooking appliance 14 can include one or multiple cross flow blowers 34 that can be used individually or in conjunction to move cooling air 16 through the ventilation system 12 for the cooking appliance 14. Also, the low pressure space 182 of the blower 34 is within the upstream region 232 of the blower 34. The cross flow blower 34 has a width that extends across most, if not all, of the cooling channel 10. A narrow portion of the cross flow blower 34 is configured to receive the ventilation channel 42. Accordingly, the low pressure space 182 formed by the blower 34 acts to draw cooling air 16 through the cooling channel 10 and contemporaneously draws cavity air 18 through the ventilation channel 42. This suction 82 through the cooling channel 10 and through the ventilation channel 42 can be performed through the use of a single low pressure space 182 formed by a single blower 34.

Referring again to FIGS. 2 and 8-10, the upper and lower blowers 214, 216 for the ventilation system 12 can be positioned such that the upper blower 214 is positioned near the upper heating cavity 92 and the lower blower 216 is positioned near the second or lower heating cavity 90. The upper and lower blowers 214, 216 may serve dedicated cooling channels 10 that extend around the upper and lower heating cavities 92, 94, respectively. Where the lower blower 216 is used to draw upper cavity air 108 from the upper heating cavity 92, the ventilation channel 42 can include a transition portion 240 that is positioned at the lower blower 216. Operation of at least the lower blower 216 forms an air acceleration section 242 within the low pressure space 182 of the lower blower 216. This low pressure space 182 draws cooling air 16 from the superior portion 210 of the outer ventilation path 170 above the lower heating cavity 90 and also draws upper cavity air 108 from the upper heating cavity 92. As discussed above, the lower blower 216 extends across a large portion of the cooling channel 10. The transition portion 240 of the ventilation channel 42 typically occupies only a small portion of the width of the lower blower 216. The lower blower 216 at the transition portion 240 moves the upper cavity air 108 through the ventilation channel 42 that is positioned within the low pressure space 182, through the blower 34 and into a lower section 244 of the ventilation channel 42 and toward the air outlet 22.

According to various aspects of the device, as exemplified in FIGS. 10, 12 and 15-17, the transition portion 240 of the lower blower 216 can receive cavity air 18 from each of the upper and lower heating cavities 92, 90. In such an embodiment, the ventilation channel 42 can extend from the upper heating cavity 92 via the upper vent aperture 102 that is disposed within the back wall 30 of the upper heating cavity 92. The ventilation channel 42 then extends from this upper vent aperture 102 and through the ventilation channel 42 that extends into the low pressure space 182 defined by the lower blower 216. Simultaneously, a second ventilation channel 220 can extend from a lower vent aperture 94 that is disposed within a top wall 52 of the lower heating cavity 90. The second ventilation channel 220 extends from the lower vent aperture 94 and through the second ventilation channel 220 and extends into the low pressure space 182 of the lower blower 216. In this manner, the low pressure space 182 of the lower blower 216 can be used to draw upper and lower cavity air 108, 100, through the ventilation channel 42 and the second ventilation channel 220. At the same time, the lower blower 216 can also be used to draw cooling air 16 around at least the lower heating cavity 90.

Referring again to FIG. 12, the ventilation channel 42, the second ventilation channel 220, and other similar ventilation channels that may serve additional heating cavities 20 define a substantially self-contained venting system for the various heating cavities 20 of the appliance 14. This vent system is contained within the cooling channel 10 of the appliance 14 and is operated by the various blowers 34 of the ventilation system 12. In this manner, the various blowers 34 of the ventilation system 12 serve to operate, contemporaneously, the movement of cooling air 16 through the various cooling channels 10 and also the movement of cavity air 18 through the various ventilation channels 42. Through the use of these integrated and contemporaneously-operating systems, additional blowers 34 are not necessary for separately operating the movement of cavity air 18 and the movement of cooling air 16 through the appliance 14.

In various aspects of the device, the upper and lower blowers 214, 216 can be used to draw cavity air 18 from the upper heating cavity 92. In such an embodiment, the ventilation channel 42 extends from the upper vent aperture 102 that is defined within the top wall 52 of the upper heating cavity 92. The ventilation channel 42 extends to the low pressure space 182 of the upper blower 214. The upper blower 214 operates to move the upper cavity air 108 through the ventilation channel 42 along the back wall 30 of the upper heating cavity 92 and toward the lower blower 216. In this embodiment, the transition portion 240 acts as a booster for assisting the movement of upper cavity air 108 through the ventilation channel 42 and toward the air outlet 22. In this embodiment, the transition portion 240 receives the upper cavity air 108 from the upper blower 214. The low pressure space 182 of the lower blower 216 increases the movement of the upper cavity air 108 through the ventilation channel 42 and pushes the upper cavity air 108 through the transition portion 240 and toward the air outlet 22. In this configuration, the upper and lower blowers 214, 216 are positioned in a series configuration, that move the upper cavity air 108 through the ventilation channel 42 and to the air outlet 22.

Referring again to FIGS. 8-10, the air acceleration section 242 that is defined by the low pressure space 182 of the lower blower 216 may also be partially formed by a narrowed transition 250 of the ventilation channel 42 that leads into the lower blower 216. By decreasing the cross-sectional size of the ventilation channel 42 at the lower blower 216, there is a decreased static pressure in the ventilation channel 42 leading into the lower blower 216. This, in addition to the low pressure space 182 of the lower blower 216, causes the cavity air 18 to accelerate as the cavity air 18 enters into the lower blower 216. The ventilation channel 42 then opens up at the high pressure outlet side 251 of the lower blower 216. In this manner, the narrow stream of cavity air 18 entering the blower 34 can be maintained within the ventilation channel 42 as the cavity air 18 passes into a wider opening of the lower section 244 of the ventilation channel 42. In this configuration, a certain amount of cooling air 16 may infiltrate into the lower section 244 of the ventilation channel 42. The infiltration of cooling air 16 can assist in containing the cavity air 18 within the ventilation channel 42 as the cavity air 18 passes through the transition portion 240 and the blower 34. Conversely, the cavity air 18, which typically includes some cooking byproducts, is substantially prevented from leaving the ventilation channel 42. Additionally, lower blower 216 generates a higher static pressure at the outlet side 254 of the lower blower 216. The increased static pressure generated at the lower blower 216 assists the lower blower 216 in moving the cavity air 18 from the upstream region 232 of the ventilation channel 42, through the transition portion 240 and to the lower section 244 of the cooling channel 10 and also substantially preventing infiltration of the cavity air 18 into portions of the cooling channel 10 outside of the ventilation channel 42.

According to various aspects of the device, as exemplified in FIGS. 12 and 15-17, the lower blower 216 can also serve as the only blower 34 of the plurality of blowers 34 for moving cavity air 18 through the ventilation channel 42. In such an embodiment, the lower blower 216 can be activated independent of the upper blower 214 to draw cavity air 18 into the ventilation channel 42. In addition to moving the cavity air 18, the lower blower 216 also moves cooling air 16, typically, from an area between the upper and lower housings 104, 96.

Referring again to FIGS. 2, 8 and 9, the upstream region 232 of the ventilation channel 42 tapers to the narrowed transition 250 in the form of a tapered area 270 that is disposed within the low pressure space 182 within the transition portion 240. When the cavity air 18 is moved through the lower blower 216, the lower blower 216 directs this cavity air 18 into the lower section 244 of the ventilation channel 42. The lower section 244 of the ventilation channel 42 extends from an enlarged portion 272 near the outlet side 254 of the lower blower 216 and again transitions down to a tapered lower end 274. As discussed above, the enlarged portion 272 assists in maintaining the cavity air 18 within the ventilation channel 42. This helps to move the cavity air 18 toward the air outlet 22 for the cooking appliance 14.

Through the use of the transition portion 240, the cooking appliance 14 is able to move cavity air 18 through the ventilation channel 42 via operation of only the lower blower 216 or through operation of the upper and lower blowers 214, 216 operating in series. In a series configuration, the lower blower 216 can be intermittently activated to assist in moving cavity air 18 through the ventilation channel 42 into the air outlet 22. Use of the upper and lower blowers 214, 216 can also be used to increase the Venturi effect of the low static-pressure regions 40 that are located at the upper and lower vent apertures 102, 94 to suction upper and lower cavity air 108, 100 from the upper and lower heating cavities 92, 90. Where additional suction 82 is needed through the upper and lower vent apertures 102, 94, the upper and lower blowers 214, 216 may be activated to increase the movement of air past the narrowed portions 38 of the ventilation channel 42 and further decrease the static pressure at the upper and lower vent apertures 102, 94. This decrease in the static pressure typically causes an increase in suction 82 from the upper and lower heating cavities 92, 90 and through the respective upper and lower vent apertures 102, 94, and into the ventilation channel 42.

Referring again to FIGS. 8-10, because the lower blower 216 is positioned between the upper and lower housings 104, 96 of the cooking appliance 14, there may be a relatively long run of ductwork between this transition portion 240 and the air outlet 22. This long run can, in certain instances, result in a pressure drop within the ventilation channel 42 at or near the lower blower 216. This pressure drop results in less suction 82 and the slower movement of cavity air 18 towards the air outlet 22. The use of the low pressure space 182 of the lower blower 216 can assist in increasing the flow of cavity air 18. Additionally, the inclusion of the transition portion 240 having the narrowed transition 250 serves to increase the suction 82 in this area by decreasing the static pressure. The use of this tapered transition portion 240 serves to counteract the pressure drop that may be experienced, due to an excessive distance between the lower blower 216 and the air outlet 22.

Figure 13:
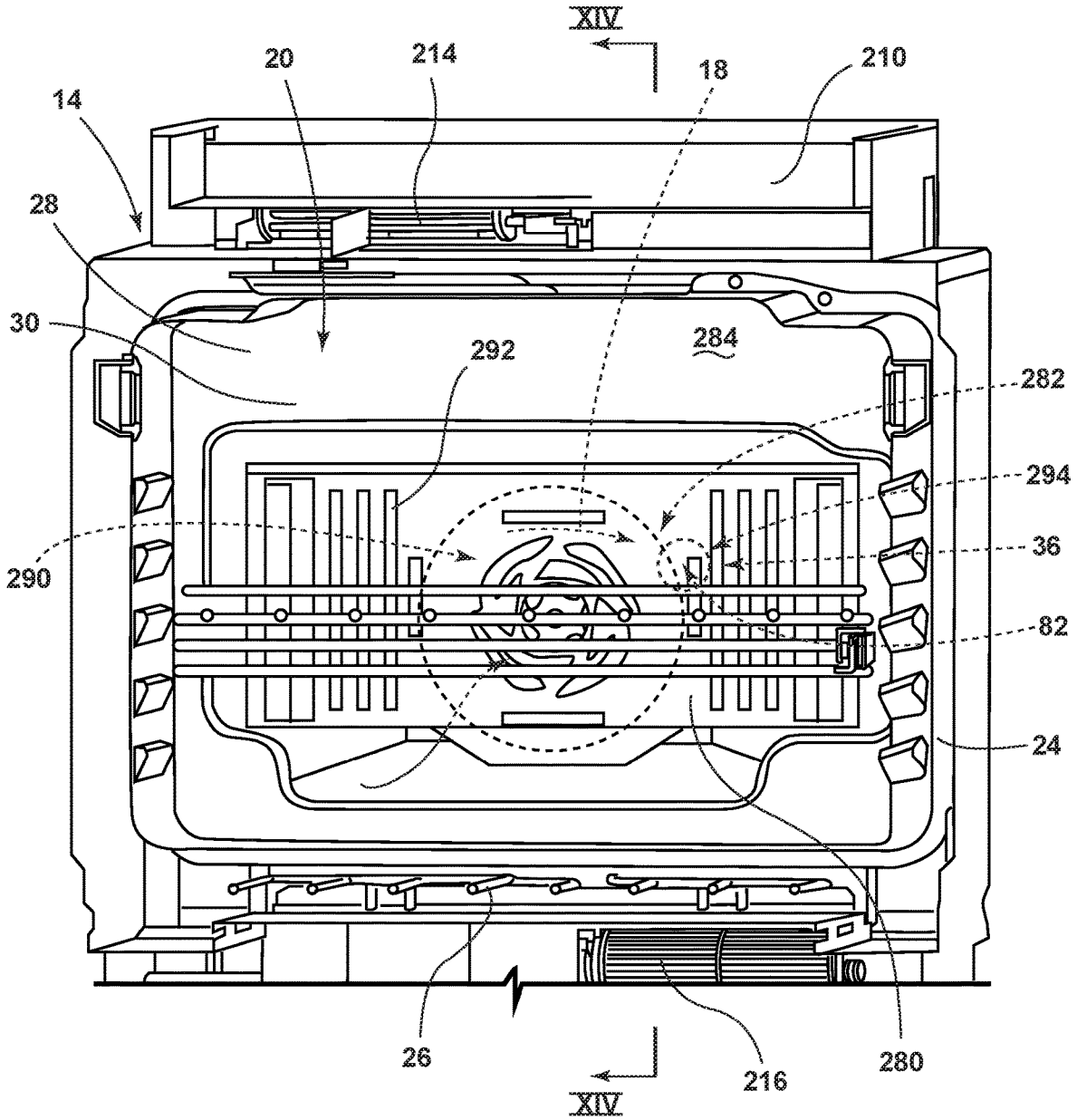
FIG. 13 is a cross-sectional view of an aspect of the cooking appliance and showing a baffle panel positioned at a rear of the heating cavity.
Figure 14:
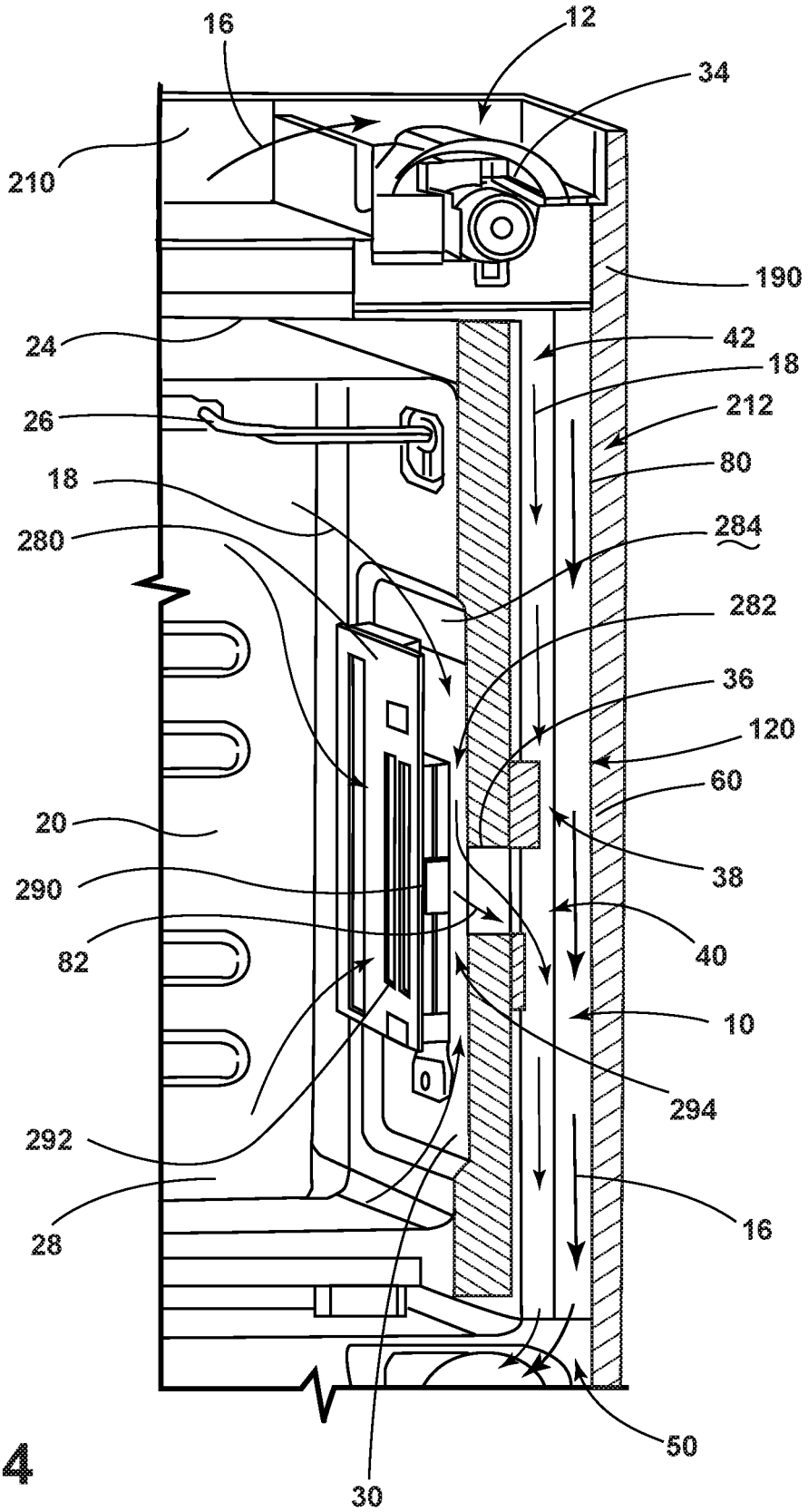
FIG. 14 is a cross-sectional view of the appliance of FIG. 13 taken along line XII-XII.

Referring now to FIGS. 13 and 14, each heating cavity 20 of the cooking appliance 14 can utilize various pressure differentials to move air from the heating cavity 20 and into the ventilation channel 42. According to various aspects of the device, the heating cavity 20 can include a baffle cover 280 that is disposed within the heating cavity 20 and proximate the vent aperture 36. A high pressure space 282 can be defined between the baffle cover 280 and the vent aperture 36. The high pressure space 282 is configured to operate cooperatively with the low static-pressure region 40 defined within the ventilation channel 42. The combination of the high pressure space 282 within the heating cavity 20 and the low static-pressure region 40 of the ventilation channel 42 serves to draw cavity air 18 from the heating cavity 20 and direct this cavity air 18 into the ventilation channel 42 via the vent aperture 36. To form this high pressure space 282, the baffle cover 280 is positioned in an offset relationship to a back surface 284 that defines the heating cavity 20.

Referring again to FIGS. 13 and 14, the baffle cover 280 can conceal a convection fan 290 that is positioned behind the baffle cover 280. During operation of the convection fan 290, movement of cavity air 18 within the heating cavity 20 generates the high pressure space 282 between the baffle cover 280 and the back surface 284 of the heating cavity 20. To assist in forming this high pressure space 282, the plurality of directing channels 292 are defined within the baffle cover 280. These directing channels 292 extend from the convection fan 290 and to an area near the vent aperture 36 for the heating cavity 20. The plurality of directing channels 292 cooperate with the convection fan 290 and the vent aperture 36 to generate the high pressure space 282 that directs the cavity air 18 from the heating cavity 20 and into the ventilation channel 42. The convection fan 290, baffle cover 280, directing channels 292 and vent aperture 36 are positioned to maximize the high pressure space 282 such that the vent aperture 36 is positioned at or near this area of highest pressure 294 within the heating cavity 20. In this manner, the cavity air 18 is directed toward the area where the vent aperture 36 is located. Accordingly, the low static-pressure region 40 is able to more conveniently draw cavity air 18 through the vent aperture 36. The combination of the high pressure space 282 and the low static-pressure region 40 within the ventilation channel 42 makes the suction 82 for drawing cavity air 18 from the heating cavity 20 more efficient. According to various aspects of the device, this configuration of the baffle cover 280 and the convection fan 290 can be disposed within each of the plurality of heating cavities 20 disposed within the cooking appliance 14.

Referring again to FIGS. 13 and 14, the use of the baffle cover 280 used in conjunction with the convection fan 290 can increase, or make more efficient, the suction 82 generated through the vent aperture 36 for drawing cavity air 18 into the ventilation channel 42. This more efficient suction 82 generated by the use of the convection fan 290 can allow designers of the appliance 14 to decrease the size of the cross fan blower 34, or other blower types, that may be used within the ventilation system 12 for the appliance 14. The use of the baffle cover 280 can make the suction 82 through the vent aperture 36 more efficient such that a single cross fan blower 34 may be utilized for moving cavity air 18 through the ventilation channel 42 and out the air outlet 22 for the appliance 14.

Referring again to FIGS. 1-14, the cooking appliance 14 can include the upper housing 104 that defines the upper heating cavity 92 and the lower housing 96 can define the lower heating cavity 90. In such an embodiment, the upper and lower housings 104, 96 can cooperate to define the housing 24 for the cooking appliance 14. The outer ventilation path 170 of the ventilation system 12 extends around at least a portion of the upper and lower housings 104, 96 to the air outlet 22. Within the outer ventilation path 170, the ventilation channel 42 is located as a substantially enclosed duct that extends at least from the upper housing 104 to the lower housing 96 and to a downstream portion 50. The upper vent aperture 102 extends through the upper housing 104 between the upper heating cavity 92 and ventilation channel 42. The lower vent aperture 94 extends through the lower housing 96 between the lower heating cavity 90 and the ventilation channel 42. According to various aspects of the device, the ventilation channel 42 extends at least between the upper and lower vent apertures 102, 94. Upper and lower deflecting bodies 300, 302 are positioned within the ventilation channel 42 proximate the upper and lower vent apertures 102, 94, respectively. In this manner, the upper and lower deflecting bodies 300, 302 form respective low static-pressure regions 40 of the cooling channel 10. Upper and lower blowers 214, 216 operate to selectively move the cooling air 16 through the outer ventilation path 170. Operation of at least the lower blower 216 contemporaneously moves cavity air 18 through the ventilation channel 42 and cooling air 16 through the outer ventilation path 170 and various cooling channels 10. Operation of the at least one blower 34 selectively defines the low pressure spaces 182 and also defines various low static-pressure regions 40 that are positioned within the ventilation channel 42, and in particular, at or near the upper and lower vent apertures 102, 94, respectively. The low static-pressure region 40 at the upper vent aperture 102, draws upper cavity air 108 from the upper heating cavity 92 and into the ventilation channel 42. The low static-pressure region 40 at the lower vent aperture 94 draws lower cavity air 100 from the lower heating cavity 90 and into the ventilation channel 42.

Referring again to FIGS. 1-7, the low static-pressure region 40 at the lower vent aperture 94 draws the lower cavity air 100 through the lower vent aperture 94 and in an exhaust direction 144 to define an air curtain 154. The air curtain 154 directs the upper cavity air 108 from the upper vent aperture 102 from an upstream area of the ventilation channel 42 toward the air outlet 22 and away from the lower vent aperture 94. Accordingly, infiltration of odors, particulate matter, cooking byproducts and other material from the upper heating cavity 92 can be prevented from entering into the lower heating cavity 90 via the lower vent aperture 94.

As discussed above, the ventilation channel 42 that extends between the upper and lower housings 104, 96 can be positioned within the cooling channel 10 and between the housing 24 and an insulation layer 190 that extends around the housing 24. The use of the insulation layer 190 serves to maintain the separated portions of the cooling air 16, the upper cavity air 108 and the lower cavity air 100 at a relatively consistent temperature to prevent condensation and the accumulation of moisture within the ventilation system 12 of the cooking appliance 14.

As exemplified in FIGS. 8-12, the at least one blower 34, such as the lower blower 216, can be positioned proximate the lower heating cavity 90. In certain embodiments, the ventilation channel 42 includes a transition portion 240 that is positioned proximate the at least one blower 34. Operation of the at least one blower 34 forms the low pressure space 182 that effectively generates an air acceleration section 242 that draws upper cavity air 108 from the upper heating cavity 92 and moves the upper cavity air 108 (separately moved within the ventilation channel 42) into a lower section 244 of the ventilation channel 42 and toward the air outlet 22. Operation of the at least one blower 34 in this transition portion 240 forms the low pressure space 182 that decreases the static pressure in this area and causes an acceleration of the cavity air 18 into the at least one blower 34 and toward a lower section 244 of the ventilation channel 42. The use of the transition portion 240 of the ventilation channel 42 serves to limit the effect of any pressure drop that may occur within the cavity air 18 as the at least one blower 34 moves the cavity air 18 toward the air outlet 22.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A cooking appliance comprising:

a housing having a first heating cavity defined therein, wherein a heat source is in thermal communication with the first heating cavity;

a second heating cavity positioned within the housing and below the first heating cavity;

a cooling channel disposed proximate a sidewall of the housing;

a blower positioned between the first and second heating cavities that selectively operates to move at least cooling air through the cooling channel and to an air outlet, wherein a transition section of the cooling channel directs upper cavity air from the first heating cavity through the blower and also directs lower cavity air from the second heating cavity from an area between the first and second heating cavities through the blower; and a baffle cover disposed within the first heating cavity proximate an upper vent aperture, wherein a high pressure space is defined between the baffle cover and the upper vent aperture, and wherein the high pressure space operates cooperatively with a low static-pressure region of the cooling channel to draw upper cavity air from the first heating cavity and direct the upper cavity air into the cooling channel via the upper vent aperture, wherein the baffle cover is positioned proximate a convection fan and the baffle cover includes a plurality of directing channels that extend from the convection fan to the upper vent aperture, wherein the plurality of directing channels cooperate with the convection fan and the upper vent aperture to generate the high pressure space that directs upper cavity air from the first heating cavity to the cooling channel.

2. The cooking appliance of claim 1, wherein the transition section defines a narrowed transition that defines a low pressure space that is adjacently upstream of the blower.

3. The cooking appliance of claim 2, wherein the first heating cavity includes a vent aperture extending through the sidewall between the first heating cavity and an upper section of the cooling channel.

4. The cooking appliance of claim 3, wherein the upper cavity air and the cooling air are combined within a downstream portion of the cooling channel that is distal from the vent aperture.

5. The cooking appliance of claim 1, wherein a lower section of the cooling channel extends from an enlarged portion adjacently downstream of the blower to a tapered lower end proximate the air outlet.

6. The cooking appliance of claim 5, wherein the second heating cavity includes a second vent aperture extending through the housing between the second heating cavity and the cooling channel.

7. The cooking appliance of claim 6, wherein the second vent aperture is positioned through a top wall of the second heating cavity.

8. The cooking appliance of claim 5, wherein the blower is a first blower, and further comprising an upper blower positioned above the first heating cavity wherein the transition section is positioned proximate the first blower and operation of at least the first blower forms an accelerated air region that draws the upper cavity air from the first heating cavity via the cooling channel and moves the upper cavity air into the lower section of the cooling channel and toward the air outlet to be combined with the cooling air.

9. The cooking appliance of claim 1, further comprising:

an insulation layer surrounding at least a portion of the housing, wherein the cooling channel is positioned between the sidewall of the housing and the insulation layer.

* * * * *